US006719395B2

(12) United States Patent
Iwasaki et al.

(10) Patent No.: US 6,719,395 B2
(45) Date of Patent: Apr. 13, 2004

(54) RECORDING APPARATUS AND TEMPERATURE DETECTING METHOD THEREFOR

(75) Inventors: Osamu Iwasaki, Tokyo (JP); Naoji Otsuka, Yokohama (JP); Atsushi Arai, Kawasaki (JP); Kentaro Yano, Yokohama (JP); Kiichiro Takahashi, Kawasaki (JP); Daigoro Kanematsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 67 days.

(21) Appl. No.: 09/978,458

(22) Filed: Oct. 15, 2001

(65) Prior Publication Data

US 2002/0041300 A1 Apr. 11, 2002

Related U.S. Application Data

(62) Division of application No. 08/839,400, filed on Apr. 11, 1997, now abandoned, which is a division of application No. 08/296,184, filed on Aug. 29, 1994, now Pat. No. 5,646,655.

(30) Foreign Application Priority Data

Aug. 31, 1993 (JP) ..... 5-215755
Aug. 31, 1993 (JP) ..... 5-215834
Jan. 25, 1994 (JP) ..... 6-006668

(51) Int. Cl.[7] ..... B41J 29/393; B41J 29/38; B41J 2/165

(52) U.S. Cl. ..... 347/19; 347/14; 347/23; 347/17

(58) Field of Search ..... 347/19, 14, 23, 347/12, 10, 11, 8, 9, 17, 20, 26, 6, 7, 60, 57

(56) References Cited

U.S. PATENT DOCUMENTS 4,125,845 A * 11/1978 Stevenson et al. ..... 347/17
4,313,124 A 1/1982 Hara ..... 347/19
4,345,262 A 8/1982 Shirato et al. ..... 347/7
4,459,600 A 7/1984 Sato et al. ..... 347/7
4,463,359 A 7/1984 Ayata et al. ..... 347/19
4,558,333 A 12/1985 Sugitani et al. ..... 347/17
4,608,577 A 8/1986 Hori ..... 347/7
4,723,129 A 2/1988 Endo et al. ..... 347/10
4,740,796 A 4/1988 Endo et al. ..... 347/15
4,896,172 A 1/1990 Nozawa et al. ..... 347/19
5,006,867 A 4/1991 Koizumi et al. ..... 347/14
5,220,345 A 6/1993 Hirosawa ..... 346/7
5,291,215 A 3/1994 Nozawa et al. ..... 346/7
5,485,179 A 1/1996 Otsuka et al. ..... 347/14
5,745,132 A 4/1998 Hirabayashi et al. ..... 347/14
5,751,304 A 5/1998 Hirabayashi et al. ..... 347/17
6,116,709 A 9/2000 Hirabayashi et al. ..... 347/14
6,139,125 A 10/2000 Otsuka et al. ..... 347/11

FOREIGN PATENT DOCUMENTS

EP 559122 1/1993 ..... 347/23
JP 54-056847 5/1979
JP 59-123670 7/1984
JP 59-138461 8/1984
JP 60-071260 4/1985
JP 5-208505 8/1993

* cited by examiner

*Primary Examiner*—Raquel Yvette Gordon
*Assistant Examiner*—Charles W. Stewart, Jr.
(74) *Attorney, Agent, or Firm*—Fitzpatrick, Cella, Harper & Scinto

(57) ABSTRACT

In a recording apparatus for effecting recording with a recording head on a recording medium, a temperature detector provided on a control circuit board of the recording apparatus detects a temperature at the board, and a timer measures a first activation time of electric power supply to the control circuit board for a control not involving a recording operation. The timing of reading the temperature detected by the temperature detector, as well as a correction value for the thus read value, are determined according to the first activation time measured by the timer.

21 Claims, 18 Drawing Sheets

| THERMAL TIME CONSTANT | SHORT RANGE TIME CONSTANT GROUP | LONG RANGE TIME CONSTANT GROUP |
|---|---|---|
| ALLOWABLE CALCULATION INTERVAL | 0.05 SEC | 1 SEC |
| DATA HOLDING TIME | 0.80 SEC | 512 SEC |

RECORDING APPARATUS AND TEMPERATURE DETECTING METHOD THEREFOR

This application is a division of application Ser. No. 08/839,400, filed Apr. 11, 1997, now abandoned, which was a division of Ser. No. 08/296,184 filed Aug. 29, 1994, now U.S. Pat. No. 5,646,655.

BACKGROUND OF THE INVENTION

1. Field of the Invention

The present invention relates to a recording apparatus and a temperature detecting method therefor, and more particularly to an ink jet recording apparatus and a temperature detecting method therefor.

2. Related Background Art

Ink jet recording apparatus has recently become popular as the inexpensive recording apparatus capable of achieving high-quality recording and color recording. The recent trend employs an interchangeable recording cartridge, integrating an ink tank for storing the recording ink and a recording head for converting the electric signal from the main body of the recording apparatus into thermal energy thereby discharging the ink.

Such recording cartridge can reduce the cost by shortening the ink flow path from the ink tank to the recording head and can also reduce the amount of ink consumption at the ink discharge recovery operation by suction. Besides, by providing the ink tank with the ink of an amount matching the service life of the recording head, the replacement of the recording cartridge provides the advantage of effecting the ink supply and the maintenance of the recording head at the same time. Furthermore there is also provided a recording apparatus in which a color recording cartridge and a monochromatic recording cartridge are interchangeably used according to the purpose of the user.

In such ink jet recording apparatus employing the recording head which utilizes thermal energy for ink discharge, a known requirement for attaining high image quality is to control the electrical signal to be supplied to the recording head, according to the temperature thereof. This is because, if the electrical signal is constant, the amount of ink discharge varies depending on the temperature of the recording head, thus resulting in temperature-dependent unevenness in image density. The temperature of the recording head may be known for example by the use of a temperature sensor, or by estimation from the recorded data.

It has also been conducted to control the temperature of the recording head, by providing the recording head with a heat generating member for heating and driving said heat generating member according to the temperature of the recording head. A closed-loop temperature control is also known for example by providing the recording head with a temperature sensor. In case of so-called serial recording apparatus in which the recording is effected by the movement of the recording head, if a temperature sensor is employed as mentioned above, there is inevitably employed a flexible cable for sending the output voltage of said temperature sensor to an A/D converter in the main body of the recording apparatus, and there is required a countermeasure for the noises resulting from such flexible cable.

Instead of the temperature sensor provided on the recording head, there may also be employed a highly precise temperature sensor, such as a thermistor, provided on the control circuit board in the main body of the recording apparatus. Such configuration is to detect the ambient temperature of the recording head and to estimate the temperature of the recording head by calculation from the variation in said ambient temperature, in consideration also of the electric energy supplied to the recording head, the energy released by ink discharge and the energy dissipated to the external atmosphere. In such configuration, the thermistor mounted on the control circuit board of the main body of the recording apparatus is subjected to the influence of heat-generating components present on said board. Consequently the ambient temperature is obtained by estimating the temperature rise of the circuit board through the control of on/off time of such heat-generating components and subtracting the temperature rise resulting from the influence of such heat-generating components from the temperature indicated by the thermistor.

However, during the use of the recording apparatus, some of such heat-generating components present on the control circuit board are continuously activated while others are activated only during certain control operations, and the above-mentioned on/off time control without distinction in such activation modes may result in an error depending on the timing of thermistor reading. On the other hand, estimation of the temperature rise for example from the motor driving conditions, in order to avoid the above-mentioned error, will require considerably complex calculations because the motor driving is complicated.

Also the above-mentioned temperature detection by the temperature sensor or by estimation from the recording data results in difficulties in case the recording cartridge is replaced to a new one after the recording head is heated by the execution of recording operation or in case the power supply of the apparatus is interrupted in the course of a recording operation.

For example the temperature estimation from the recording data requires history of the past recording operation, but such history becomes no longer usable in case the recording head is replaced as explained above.

Also in recent years, the number of recording elements has been increased for improving the recording throughput, since such increase in the number of recording element increases the number of pixels recordable in a single recording scan motion. On the other hand, such increase in the number of recording elements also leads to an increase in the temperature rise of the recording head, because of the increased heat generation of the recording elements. Also in case the throughput is improved by an increase in the driving frequency for the recording elements, there will result an increased temperature rise in the recording head because of an increase in the heat accumulation per unit time. Stated differently, an increased work rate given to the chip of the recording head increases the temperature rise in said chip. An excessively high temperature thus encountered in the chip of the recording head may lead to difficulties such as deformation of the constituent parts of the recording head.

For this reason the chip of the recording head is equipped with a temperature sensor, for constantly monitoring the temperature of said chip, and there is provided a protective sequence for suspending the activation of the recording elements in case a dangerous temperature is reached.

In general, the temperature sensor is composed of a diode sensor formed on a same silicon chip as that of the ink discharge heaters, because such sensor formed by film forming technologies is inexpensive and also because such sensor, formed on the silicon substrate of high thermal conductivity, is excellent in response. However, in the temperature-voltage relationship of such sensor, it is very difficult, within the manufacturing fluctuation, to retain zero-cutoff (offset) of said relationship within a practically acceptable tolerance, though the slope of said relationship can be well controlled. For this reason, the following process is adopted for calibrating the above-mentioned offset. In this process there are memorized a temperature (Tdef) corresponding to the voltage when the recording head is not heated and is equal to the room temperature, and a room temperature (Tr) obtained by the thermistor of the main body of the recording apparatus. For a temperature Tdi corresponding to the voltage of the head diode sensor at a certain state, the head temperature Th in said state can be given by:

$$Th=Tdi+Tadj$$

$$Tadj=Tr-Tdef.$$

Tadj mentioned above corresponds to the offset value of the head diode sensor.

However, if the recording head is replaced after it is heated, or if the user repeats the on/off operation of the power supply of the main body of the recording apparatus, the head reference temperature Tdef, indicated by the diode sensor, becomes erroneously set as the recording head temperature becomes higher than the room temperature. On the other hand, if a waiting period is programmed until the initial temperature is reached, the recording operation may not be conducted with the optimum conditions immediately after the mounting of the recording head.

SUMMARY OF THE INVENTION

An object of the present invention is to provide a recording apparatus, and a temperature detecting method therefor, enabling appropriate control according to the temperature of the recording head.

Another object of the present invention is to provide an ink jet recording apparatus, capable of more accurately detecting the ambient temperature of the recording head, utilizing a temperature sensor on the control circuit board in the main body of the recording apparatus.

Still another object of the present invention is to provide an ink jet recording apparatus capable of suitable temperature setting of the recording head, utilizing a temperature sensor of the recording head, even after the replacement of the recording head cartridge or after the interruption in the power supply.

Still another object of the present invention is to provide a recording apparatus and a temperature detecting method for the recording head, enabling accurate and simple setting of the offset value of the temperature detecting mechanism of the recording head.

The above-mentioned objects can be attained, according to the present invention, by a recording apparatus for recording with a recording head on a recording medium, comprising:

temperature detection means provided on a control board of said recording apparatus and adapted for detecting the temperature at said control board;

timer means for measuring a first activation time of power supply to said control board for a control not involving the control of the recording operation; and determination means for determining the timing of reading of the temperature detected by said temperature detection means and a correction value for thus read temperature, according to said first activation time measured by said timer means.

Also according to the present invention, there is provided a temperature detecting method for a recording apparatus for effecting recording with a recording head on a recording medium, comprising steps of:

preparing temperature detection means provided on a control board of said recording apparatus and adapted for detecting the temperature at said control board;

measuring a first activation time of power supply to said control board for a control not involving the control of the recording operation; and determining the timing of reading of the temperature detected by said temperature detection means and a correction value for thus read temperature, according to said measured first activation time.

Also according to the present invention, there is provided a recording apparatus for effecting recording with a recording head on a recording medium, comprising:

detection means for detecting the temperature of said recording head;

obtention means for obtaining the temperature of said recording head n times ($n \geqq 2$) under a certain temperature condition by means of said detection means;

determination means for determining the initial temperature of said recording head, corresponding to the ambient temperature thereof, based on n temperature values obtained by said n obtentions of said obtention means, intervals of said n obtentions and said certain temperature condition; and estimation means for estimating the temperature of said recording head, based on the initial temperature of said recording head determined by said determination means, said ambient temperature and the detected temperature of said recording head detected by said detection means.

According to the present invention, there is also provided a temperature detecting method for a recording apparatus for effecting recording with a recording head on a recording medium, comprising steps of:

obtaining the temperature of said recording head n times ($n \geqq 2$) under a predetermined temperature condition with a predetermined time interval;

determining the initial temperature of said recording head, corresponding to the ambient temperature thereof, based on the n temperature values obtained by said n obtentions, the intervals of said n obtentions and said predetermined temperature condition; and estimating the temperature of said recording head, based on said determined initial temperature, said ambient temperature and the obtained temperature of said recording head.

Also according to the present invention, there is provided a recording apparatus adapted to execute recording control according to the temperature of a recording head, comprising:

first detection means for detecting the temperature of said recording head;

second detection means for detecting the ambient temperature which is the temperature of ambience of said recording head;

setting means for setting, at a predetermined timing, an offset value based on the temperature of said recording head and on said ambient temperature;

correction means for effecting a correction based on said offset value, on the temperature detected by said first detection means, thereby obtaining a head temperature which is the temperature of said recording head; and renewal means for renewing said offset value based on said head temperature and said ambient temperature, between the repeated detections of said head temperature.

Also according to the present invention, there is provided a temperature detecting method for a recording head, comprising:

a first detection step for detecting the temperature of said recording head;

a second detection step for detecting the ambient temperature which is the temperature of ambience of said recording head;

a setting step for setting, at a predetermined timing, an offset value based on the temperature of said recording head and said ambient temperature;

a correction step for effecting a correction based on said offset value, on the temperature detected in said first detection step, thereby obtaining a heat temperature which is the temperature of said recording head; and a renewal step for renewing said offset value based on said head temperature and said ambient temperature, between the repeated detection of said head temperature.

According to the above-explained configurations, the value read by the temperature detection means such as a thermistor is disregarded while the temperature of the control board is unstabilized in its control, for example by the heat generated by the heat-generating parts on the control board, and the value detected by the temperature detection means is read, after the temperature stabilization, and is suitably corrected as the ambient temperature.

Also according to the above-explained configurations, at the mount of a new recording head or at an equivalent state, the value detected by the temperature sensor provided on the recording head is obtained at least twice with a predetermined time interval, then the detection value of the temperature sensor corresponding to a predetermined ambient temperature is determined from the trend of the obtained detected values, and the head temperature is estimated from said detection value.

Furthermore, according to the above-explained configurations, it is rendered possible to renew, in succession, the offset value, essential for the precise detection of head temperature, based on the detected head temperature and the ambient temperature, thereby bringing the offset value closer to the more accurate value in the course of repetition of the temperature detections.

DETAILED DESCRIPTION OF THE PREFERRED EMBODIMENTS

Now the present invention will be clarified in detail by preferred embodiments thereof, with reference to the attached drawings.

[1st Embodiment]

Figure 1:
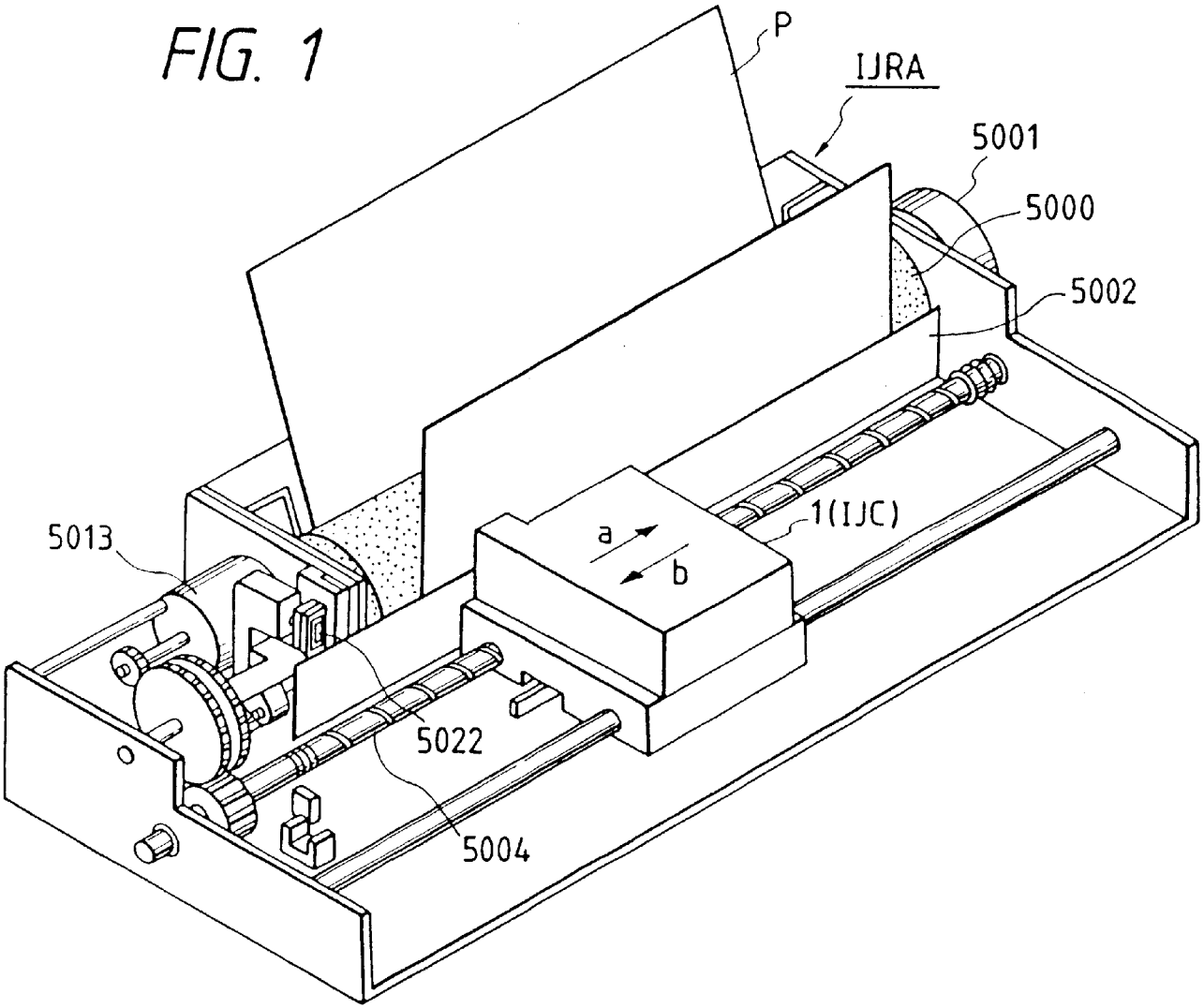
FIG. 1 is a perspective view showing an example of the ink jet recording apparatus in which the present invention is applicable.

FIG. 1 is a schematic perspective view of an ink jet recording apparatus (IJRA) constituting an embodiment of the present invention.

Referring to FIG. 1, an ink tank-integrated recording head (IJC) 1 can be moved in a direction a or b, by the driving force of a carriage motor 5013 transmitted through a lead screw 5004. During said movement, ink droplets are discharged from the recording head IJC onto a recording medium P, thereby achieving recording thereon. The recording medium P is pinched between a transport roller 5000 and a pressure plate 5002, formed for example of a stainless steel plate, and is transported by the rotation of the transport roller 5000, driven by a line feed motor 5001. At a home position in the moving path of the recording head IJC, there is provided a cap 5022 for covering the orifice face of the recording head, and said cap 5022 can be advanced to or retracted from the recording head IJC by means of the lead screw 5004, in relation to the movement of the recording head IJC.

Figure 2:
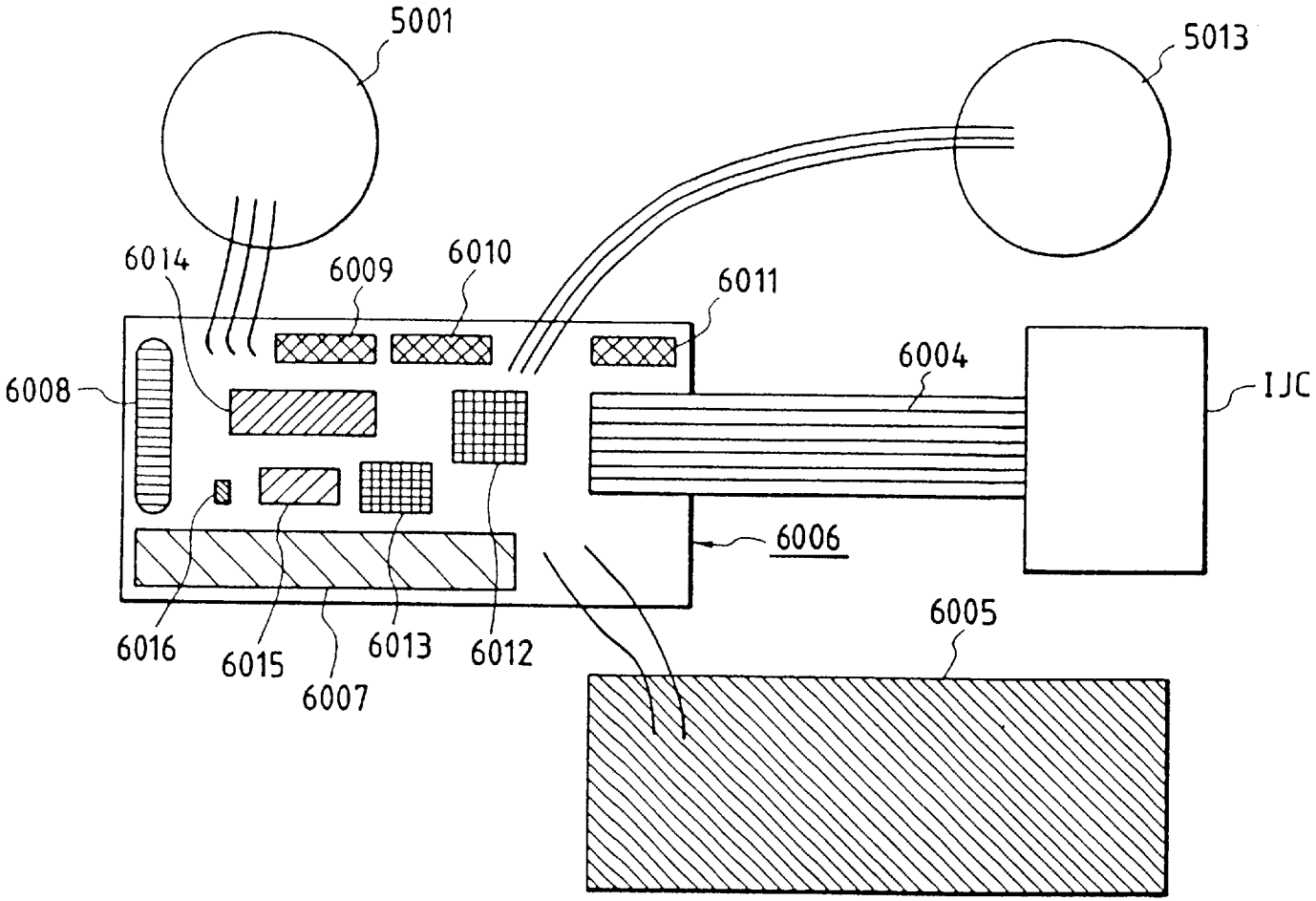
FIG. 2 is a schematic view showing the configuration principally of a control circuit board in said recording apparatus.

FIG. 2 is a schematic view showing the electrical configuration of the ink jet recording apparatus mentioned above.

Referring to FIG. 2, a control circuit board 6006 is powered by a power supply unit 6005. The board 6006 is connected to the recording head IJC through a flexible cable 6004. On said board 6006, there are provided a head driver IC 6011 for controlling the ink discharge of the recording head IJC, a carriage motor driver IC 6010 for driving the carriage motor 5013, a line feed motor driver IC 6009 for driving the line feed motor 5001, an interface 6008, a DRAM 6015, a ROM 6014, an MPU 6012, a gate array 6013, and a control panel unit 6007 for keys and LED's. Also on said board 6006 there are provided unrepresented resistors and capacitors. Among such heat-generating components on the board 6006, there is provided a relatively inexpensive thermistor 6016 for detecting the temperature of said board 6006. The processes explained in the following are naturally executed principally by the MPU 6012.

Figure 3:
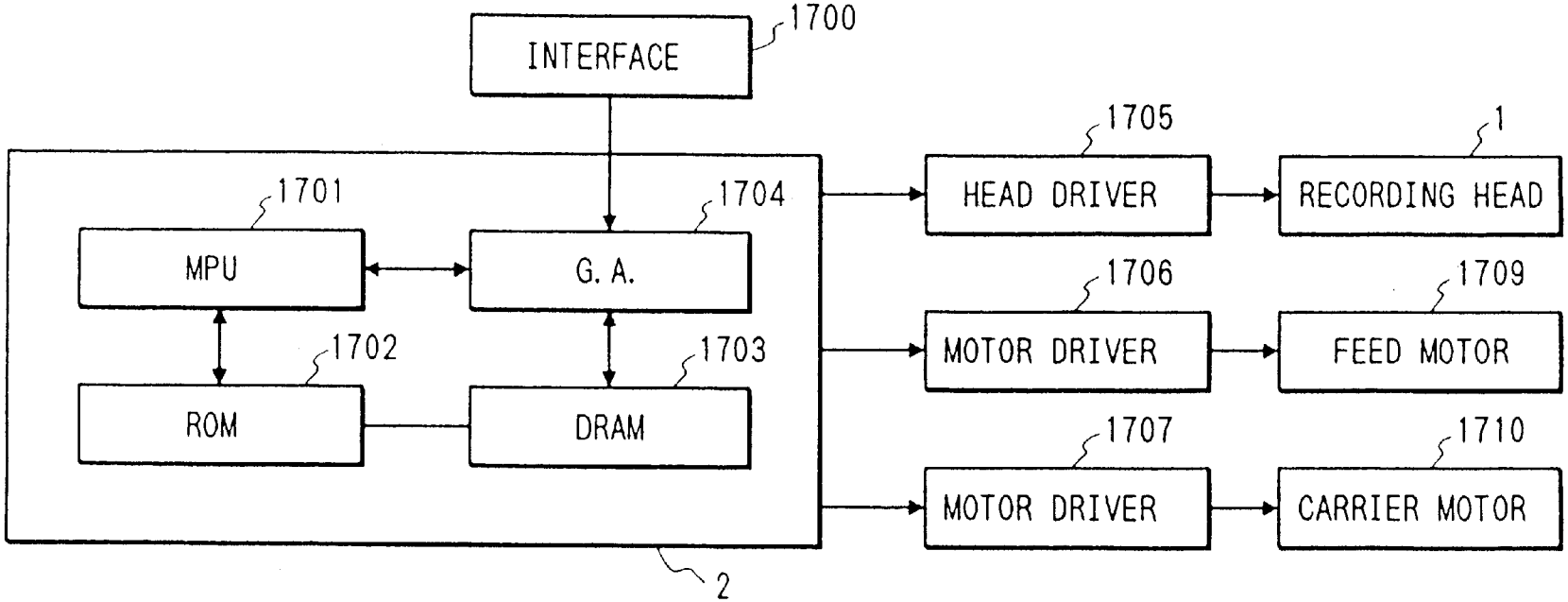
FIG. 3 is a block diagram showing the schematic configuration for recording control in the ink jet recording apparatus shown in FIG. 1.

In the following there will be explained the schematic configuration for effecting the recording control of the apparatus explained above, with reference to a block diagram shown in FIG. 3, in which there are shown an interface 1700 for entering the recording signal, an MPU 1701, a program ROM 1702 storing control programs to be executed by the MPU 1701, and a dynamic RAM 1703 for storing various data (above-mentioned recording signal, recording data to be supplied to the recording head etc.). These components are contained in a control unit 2. Also the control programs for the sequences represented by the following flow charts are also stored in the ROM 1702. A gate array 1704 for controlling the supply of recording data to a recording head 1, also controls the data transfer among the interface 1700, MPU 1701 and RAM 1703. There are also provided a carrier motor 1710 for moving the recording head 1, a motor 1709 for transporting the recording sheet, a head driver 1705 for driving the head, and motor drivers 1706, 1707 for respectively driving the transport motor 1709 and the carrier motor 1710.

In the above-explained control system, the recording signal entered from the interface 1700 is converted into recording data for printing by the gate array 1704 and the MPU 1701. Then, in synchronization with the activation of the motor drivers 1706, 1707, the recording head 1 is driven according to the recording data supplied to the head driver 1705, thereby effecting the recording.

Figure 4:
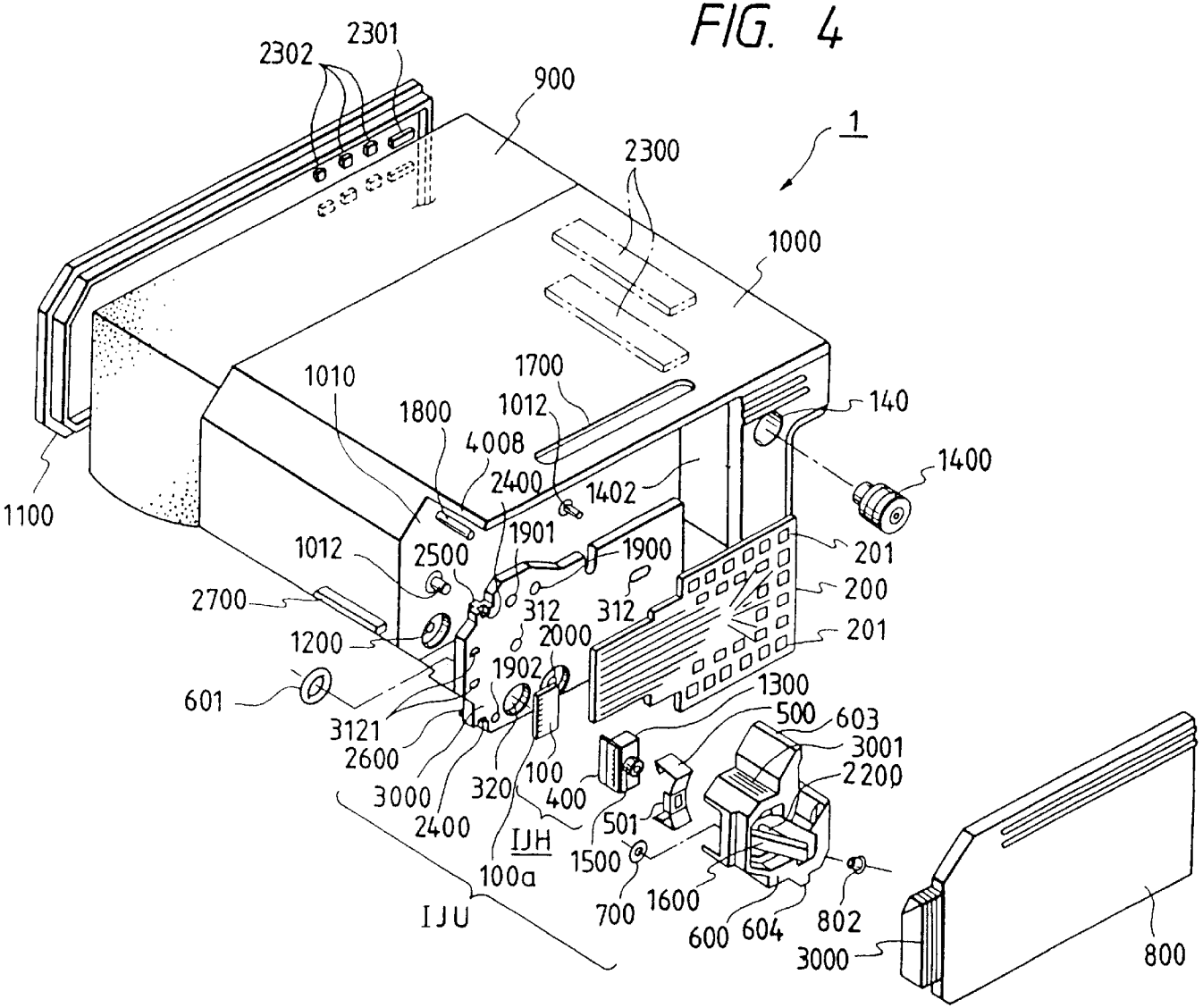
FIG. 4 is an exploded perspective view showing the structure of an ink jet recording head in an embodiment of the present invention.

Now reference is made to FIG. 4 showing the configuration of the ink jet recording head 1 of the present embodiment, which effects recording by means of electrothermal converting elements for generating thermal energy for inducing film boiling in the ink according to the electrical signals. Referring to FIG. 4, a heater board 100 is provided, on a silicon substrate, with electrothermal converting elements 100*a* (discharge heaters) arranged in plural arrays, a diode sensor for temperature detection, and electric wirings for example of aluminum, all formed by film forming technologies. A printed circuit board 200 for the heater board 100 is provided with wirings corresponding to those of the heater board 100 (connected for example by wire bonding method) and a pad 201 positioned at an end position of said wirings and adapted to receive the electrical signals from the main body of the apparatus.

A grooved ceiling plate 1300, provided with partitions for separating plural ink flow paths and with a common liquid chamber, integrally includes an ink receiving aperture 1500 for introducing the ink from the ink tank into the common liquid chamber and an orifice plate 400 provided with plural ink discharge openings. Such integral structure is preferably formed with polysulfone but it may also be formed with other materials. An aluminum support member 300, for supporting the rear face of the wiring board 200 in flat state, constitutes the bottom plate of the ink jet unit. A pressure spring 500 of M-shape, presses the common liquid chamber at the central portion of said M-shape, and also linearly presses a part of the ink liquid paths by a front portion 501. A leg of said pressure spring engages with the rear face of the support member 300 through a hole 3121 thereof, whereby the heater board 100 and the ceiling plate 1300 are mutually engaged and fixed under pressure, by the biasing force of the pressure spring 500 and the front portion 501 thereof.

The support member 300 is also provided with a hole 320 for passing an ink supply tube 2200. The wiring board 200 is mounted to the support member 300 for example with an adhesive material. An ink supply member 600, having parallel grooves 3001, is provided with an ink conducting tube 1600, connecting to said ink supply tube 2200 and formed as a projecting beam fixed at the side of said ink supply tube 2200, and a sealing pin 602 is inserted in order to secure the capillary action between the fixed side of the ink conducting tube and the ink supply tube 2200. Said ink supply member 600, being formed as a molded member, is inexpensive, also has high positional precision and avoids loss in precision in the molding. Besides, by means of the projecting beam-shaped conducting tube 1600, the pressure contact state of the conducting pipe 1600 to the aforementioned ink receiving aperture 1500 can be stably secured even with mass produced components. In this embodiment, a complete communication state can be securely obtained by merely flowing sealing adhesive from the side of the ink supply member in said pressure contact state.

The ink supply member 600 can be easily fixed to the support member 300 by passing rear pins (not shown) of the ink supply member 600 through holes 1901, 1902 of the support member 300 and fusing the protruding portions of said pins.

In the following there will be explained the calibrating method for the detected value of the above-mentioned thermistor, according to the present invention.

Figure 5:
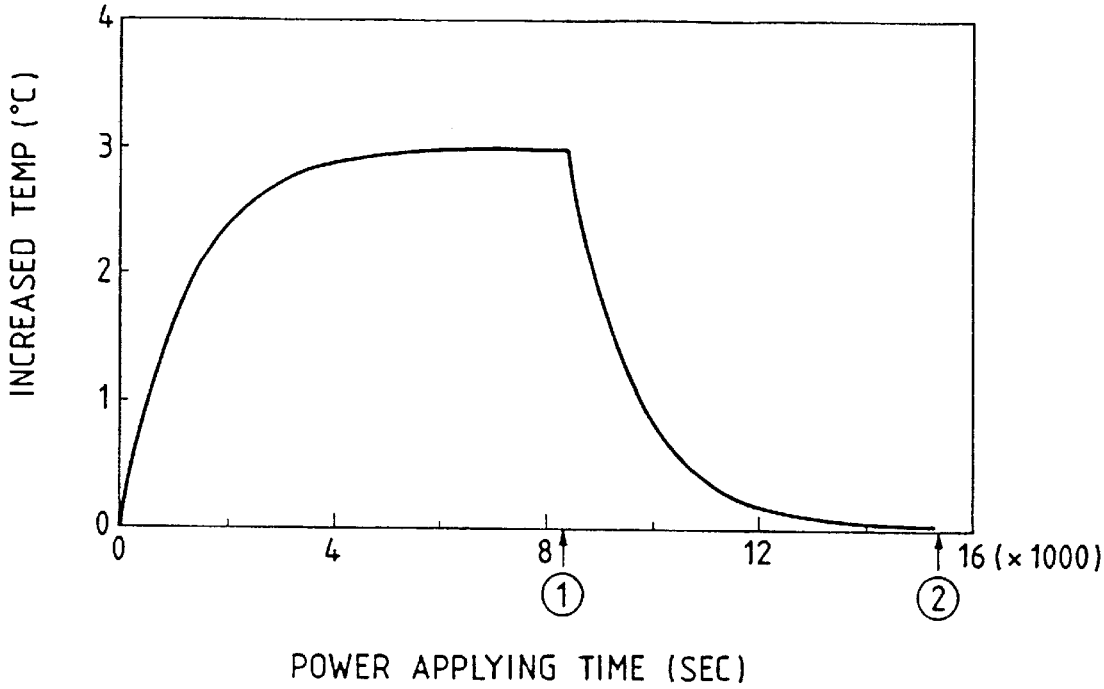
FIG. 5 is a chart showing the temperature rise characteristics of the above-mentioned control circuit board by power supply.
Figure 6:
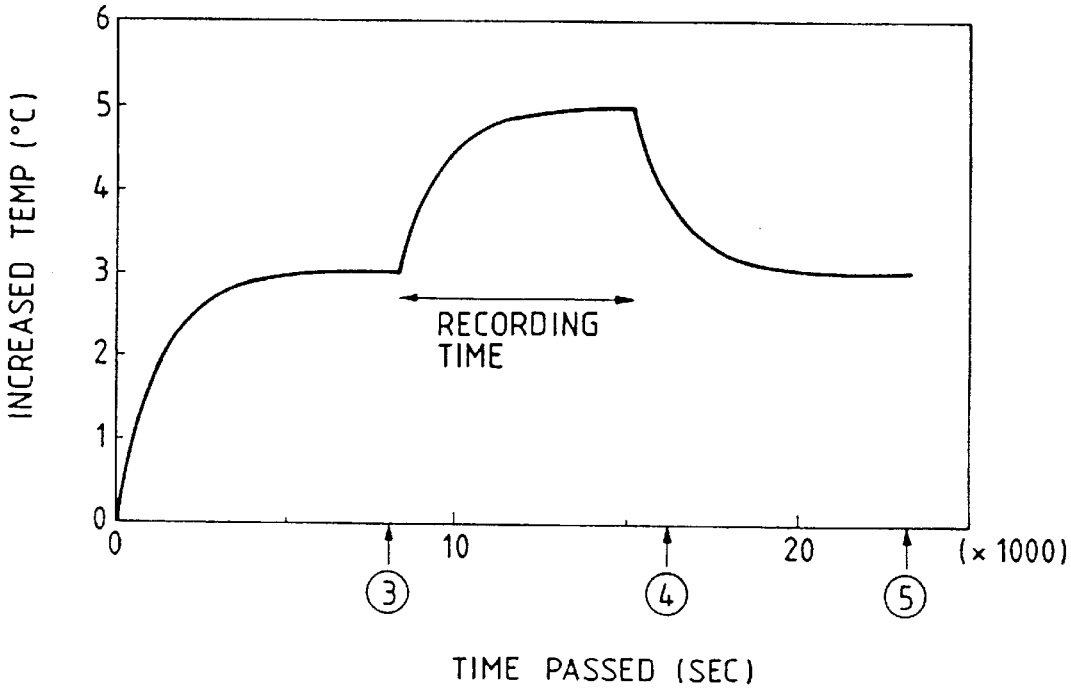
FIG. 6 is a chart showing the temperature rise characteristics of the above-mentioned control circuit board by power supply and by recording.

FIG. 5 is a chart showing the relationship between the activation time of the board and the temperature rise, in which the power supply is continued until the temperature reaches saturation and the power supply is subsequently turned off. Also FIG. 6 shows the relationship between the elapsed time and the temperature rise when the board temperature reaches saturation by power supply, then is brought to another saturation level by the subsequently started recording operation, which is subsequently terminated.

As will be apparent from these data, the time from the start of power supply to the arrival at the saturation temperature is approximately equal to the time of temperature descent from said saturation temperature to the original state (temperature rise=0° C.) and also to the time required for descent of the temperature rise induced by the recording operation.

Figure 7:
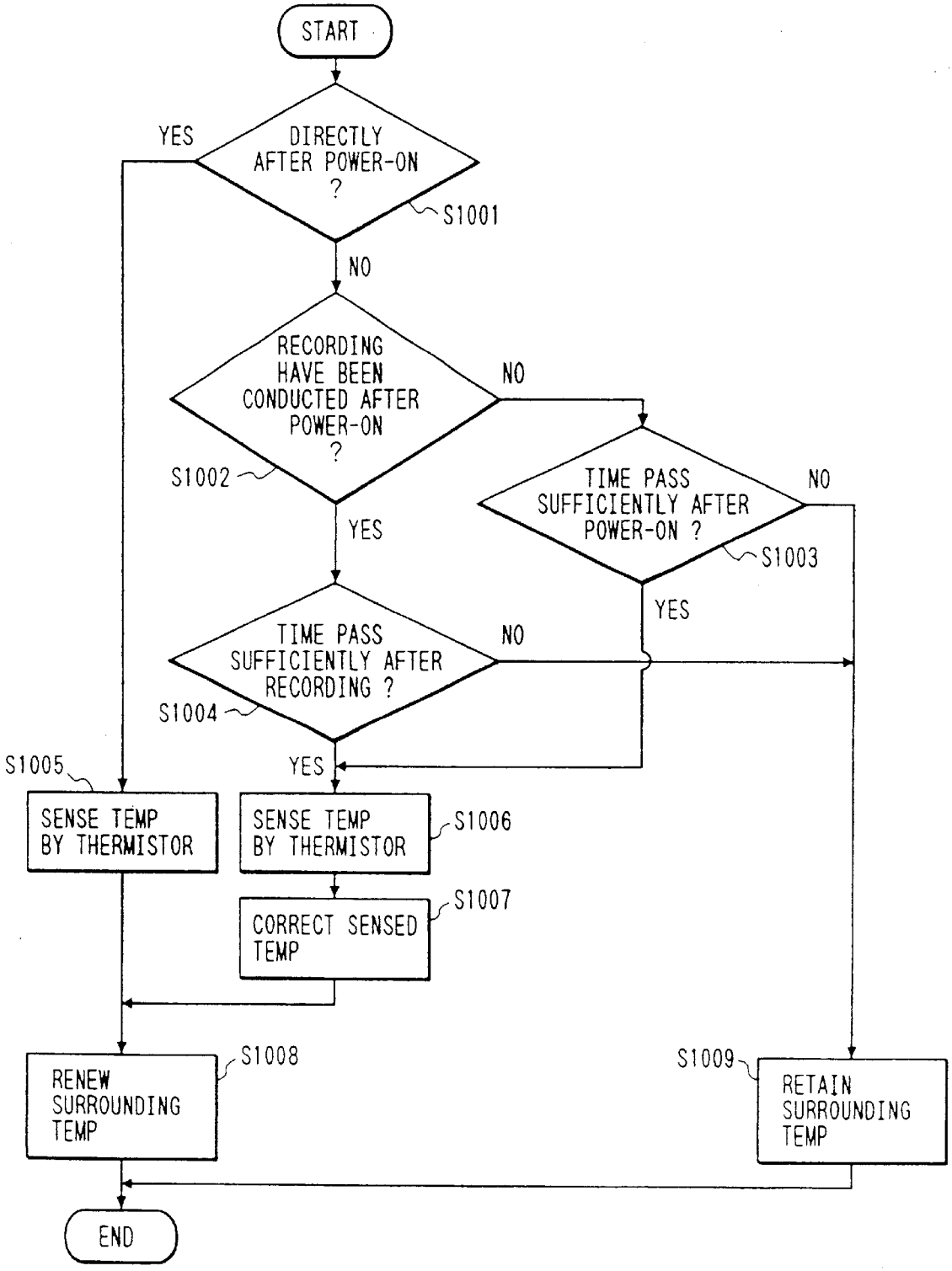
FIG. 7 is a flow chart showing the ambient temperature detecting sequence in a first embodiment of the present invention.

FIG. 7 is a flow chart showing the calibrating method for the detected value of the thermistor of the present embodiment, employing the above-mentioned time $t_{SAT}$.

In this flow chart, there is at first discriminated whether the power supply has just been turned on (step S1001), and, if so, the control circuit board in the main body of the recording apparatus is regarded to have not accumulated heat. Thus a step S1005 causes the thermistor 6016 to reach the board temperature, and a step S1008 selects the read temperature as the surrounding ambient temperature.

On the other hand, if the start of power supply is not immediately before, there is discriminated the presence of thermal influence by the recording operation. For this purpose, a step S1002 discriminates if there has been executed a recording operation, and, if not, the control circuit board of the main body is regarded to have not experienced heat accumulation by the recording operation and a step S1003 discriminates whether the time $t_{SAT}$ required for the board to reach the saturation temperature has elapsed. If said time has elapsed ((1) in FIG. 5), a step S1006 causes the thermistor to read the board temperature, then a step S1007 subtracts the temperature rise corresponding to the saturation temperature from the board temperature, and a step S1008 sets the obtained difference as the surrounding ambient temperature.

On the other hand, if the step S1003 identifies that the saturation temperature by the power supply has not been reached, namely that the above-mentioned time $t_{SAT}$ has not elapsed, the previously set surrounding temperature is retained (step S1009).

In case the step S1002 identifies that the recording operation has been executed, a step S1004 discriminates, for judging the thermal influence of the recording operation, whether the time $t_{SAT}$, required for the temperature to completely descend from the saturation level after the recording operation, has elapsed ((5) in FIG. 6). If said time has elapsed, the board temperature is regarded at the saturation temperature induced by the power supply, and the surrounding ambient temperature is renewed by the sequence starting from the step S1006.

On the other hand, if the step S1004 identifies that the thermal influence by the recording operation still remains, namely that the above-mentioned time has not elapsed after the termination of the recording operation ((4) in FIG. 6), the previously set surrounding temperature is retained (step S1009).

The above-explained process allows to avoid the irregular thermal influence of the components generating heat in the recording operation.

In the present embodiment, there is employed an approximation that the time required to reach the saturation temperature by power supply and the time required for complete descent of the temperature rise caused by the power supply are equal to $t_{SAT}$, but the present invention is not limited to such case.

[2nd Embodiment]

In case the control circuit board shows a significant temperature rise, the thermal influence thereof to the recording head becomes no longer negligible. This embodiment provides the calibrating method for the value read by the thermistor in such case.

Figure 8:
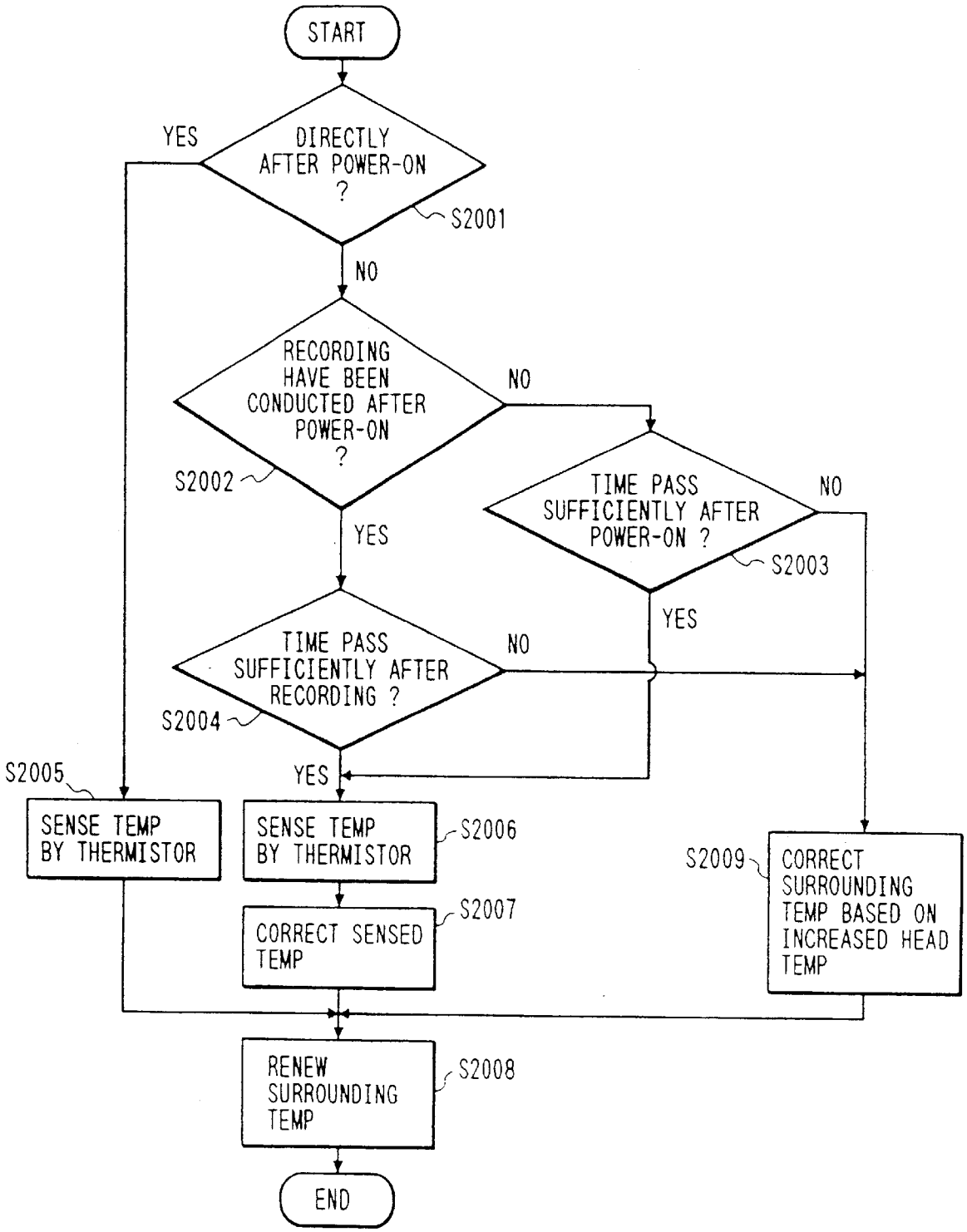
FIG. 8 is a flow chart showing the ambient temperature detecting sequence in a second embodiment of the present invention.
Figure 9:
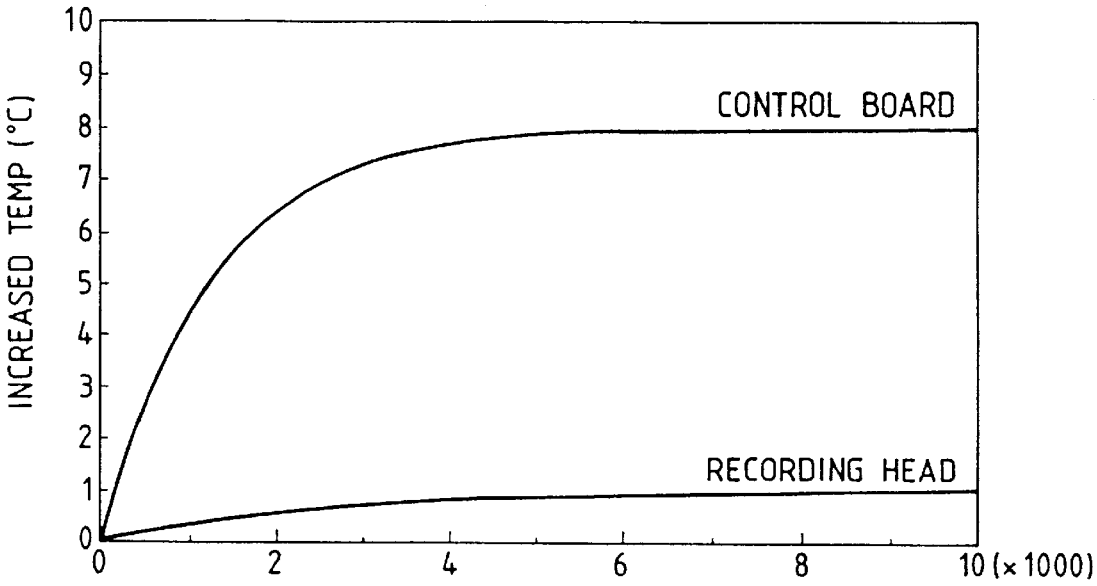
FIG. 9 is a chart showing the temperature rise characteristics of the control circuit board and the recording head by power supply.

FIG. 8 is a flow chart showing said calibrating sequence, and FIG. 9 is a chart showing the temperature rise of the control circuit board and the recording head as a function of the power supply time.

The difference between the saturation temperature of the board and that of the recording head, when the board is at said saturation temperature, is determined in advance from the relationship shown in FIG. 9, and the value read by the thermistor when the board is at said saturation temperature is corrected according to said difference (steps S2006 and S2007 in FIG. 8). In this manner the finally estimated temperature of the recording head can be made more exact, based on thus corrected value (surrounding ambient temperature). Also in case the control circuit board has not reached the saturation temperature by power supply, a step S2009 in FIG. 8 corrects the surrounding ambient temperature, corresponding to the temperature rise of the recording head predetermined from the relationship shown in FIG. 9.

Thus the read value of the thermistor can be appropriately corrected even in case the control circuit board shows a large temperature rise.

[3rd Embodiment]

This embodiment provides a calibrating method for the read value of the thermistor, corresponding to an ink jet recording apparatus in which the electric power supply to the control circuit board can be reduced to a minimum necessary level by key operations on said circuit board. Such key operations shall hereinafter be referred to as soft power supply on/off operations.

The relationship between the time required for the control circuit board to reach the saturation temperature and the time required for complete descent from such saturation temperature, explained before in relation to FIGS. 5 and 6, is retained also in case of such soft power supply, as in the case of ordinary power supply, because the thermal time constant of the control circuit board itself does not depend on the magnitude of the energy supplied to the board.

Figure 10A:
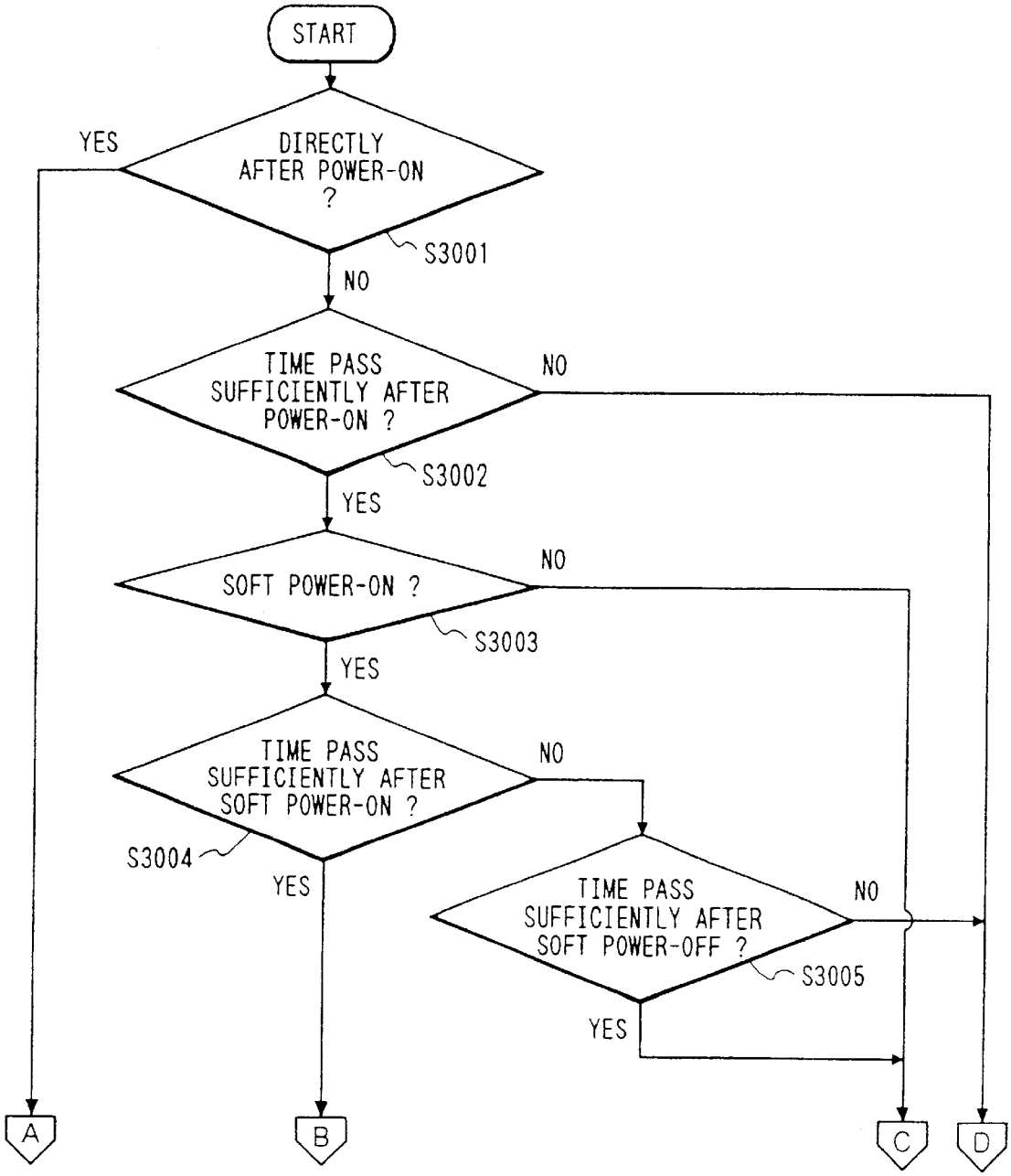
FIGS. 10A and 10B are flow charts showing the surrounding ambient temperature detecting sequence in a third embodiment of the present invention.
Figure 10B:
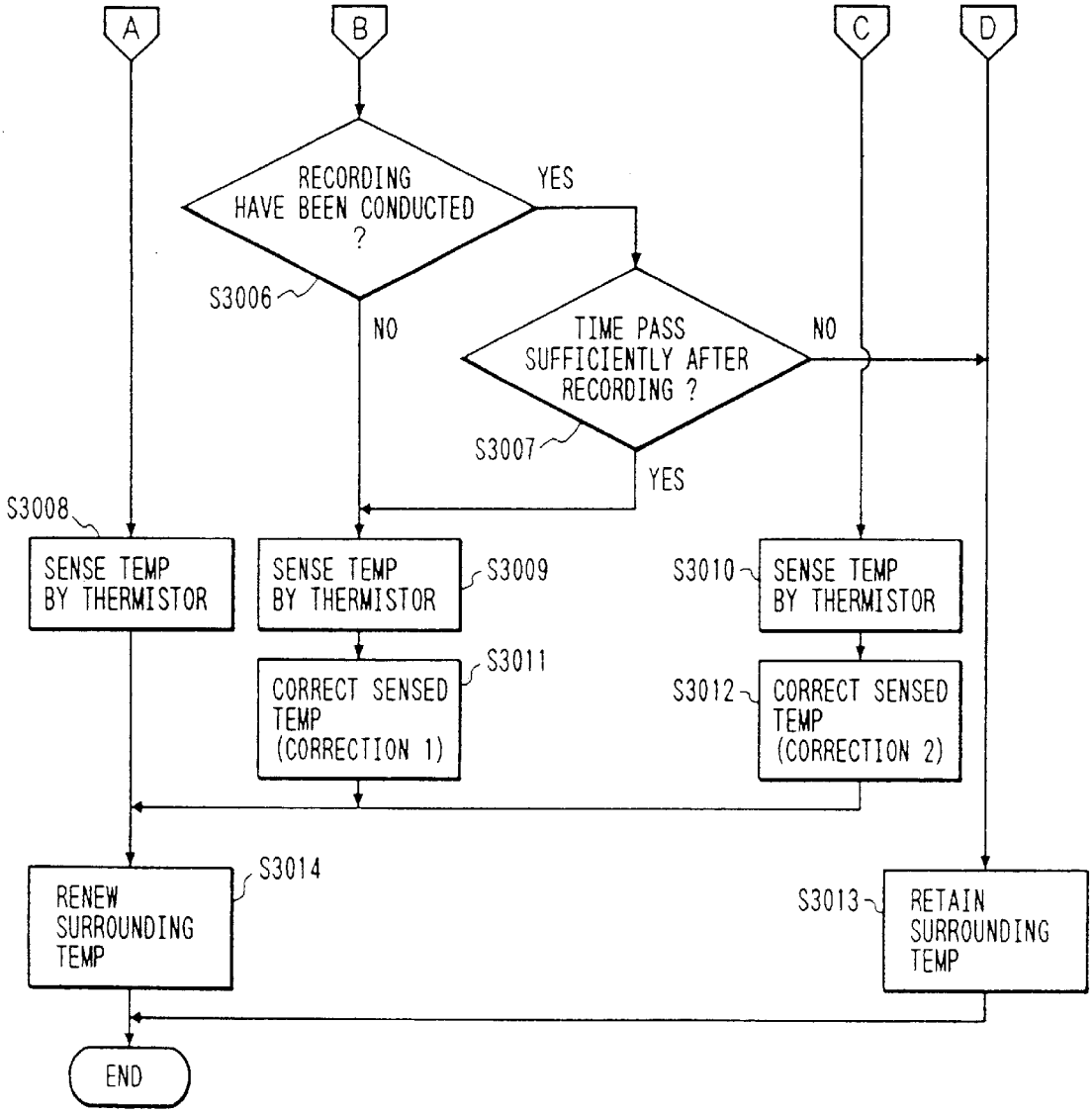

In the following the process of the present embodiment will be explained with reference to flow charts shown in FIGS. 10A and 10B.

At first, if a step S3001 identifies that the power supply has just been turned on, the read value of the thermistor is, without correction, employed as the surrounding ambient temperature (steps S3008 and S3014) as in the foregoing embodiments. Then there is discriminated whether the time from the start of power supply has reached the time required for the control circuit board to reach the saturation temperature (step S3002), and, if not, the previously set surrounding temperature is retained (step S3013).

In case the elapsed time is identified enough to reach the saturation temperature, there is thus considered the temperature rise of the circuit board by the soft power supply. At first there is discriminated whether the soft power supply has been turned on after the start of the power supply (step S3003). If not, the temperature rise of the control circuit board by the soft power supply need not be considered, so that the read value of the thermistor is considered to be aberrated by the saturated temperature rise caused by the ordinary power supply. Consequently a step S3010 reads the detected value of the thermistor and there is executed a correction corresponding to the saturated temperature rise of the control circuit board caused by the ordinary power supply (step S3012; said correction being hereinafter referred to as correction process 2).

On the other hand, if the step S3003 identifies that the key operation for the soft power supply has been executed, a step S3004 discriminates whether the time from the start of the soft power supply has exceeded the time required for the control circuit board to reach the saturation temperature by the soft power supply. If not, a step S3005 discriminates whether the soft power supply is off and whether there has elapsed a time required for the thermal influence of the soft power supply to disappear. If such time has elapsed, there is only required consideration for the saturated temperature rise by the ordinary power supply. Thus the board temperature detected by the thermistor is read (step S3010), and the surrounding ambient temperature is renewed by the correction process 2 (step S3014). On the other hand, if the step S3005 identifies that the thermal influence by the soft power supply still remains, the surrounding ambient temperature is retained without change (step S3013).

In case the step S3004 identifies that a sufficient time required for the control circuit board to reach the saturation temperature by the soft power supply has elapsed, steps S3006 and S3007 discriminate, as in the foregoing embodiments, whether the thermal influence by the recording operation is negligible. If there remains thermal influence, the surrounding temperature is retained without change (step S3013). In case there is no thermal influence, the board temperature indicated by thermistor, read in the step S3009, is corrected by the saturated temperature rise of the board by the ordinary power supply and by the saturated temperature rise by the soft power supply (step S3011), and the surrounding temperature is accordingly renewed (step S3014).

The above-explained process enables the correction of the board temperature rise corresponding to the soft power supply on/off operations, thus providing an effect similar to that of the foregoing embodiments.

As will be apparent from the foregoing explanation, in the 1st to 3rd embodiments, the value read by the temperature detection means such as thermistor is disregarded while the temperature of the control circuit board is unstable in the control thereof, for example by the heat generated by the heat-generating components on said board, and said detected value is read after the stabilization of the temperature and used as the surrounding ambient temperature after correction.

As a result, the temperature ambience of the recording head can be known more exactly, and it is thus rendered possible to achieve satisfactory drive and temperature control of the recording head, thereby attaining stable ink discharge, according to the surrounding temperature with an inexpensive and simple configuration.

Also in the above-explained embodiments, the corrected surrounding temperature may be employed for the estimation of the head temperature according to the prior technology or for effecting the drive or temperature control of the recording head based on thus estimated head temperature.

[4th Embodiment]

Figure 11:
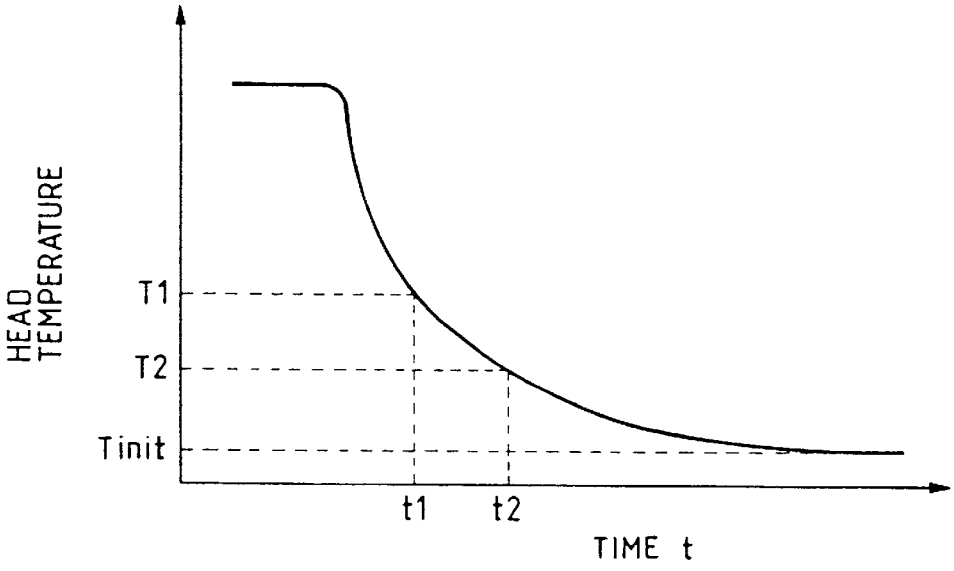
FIG. 11 is a chart showing the temperature estimation for the recording head in a fourth embodiment of the present invention.

In this embodiment, the temperature indicated by a diode sensor on the recording head is set corresponding to the room temperature, as will be explained in the following with reference to FIG. 11. The apparatus and the circuit configuration of this embodiment are same as those in the foregoing 1st to 3rd embodiments, though this embodiment does not employ the thermistor.

At a room temperature $T_r$, the head temperature $T_n$ and the head temperature $T_{n+1}$ after a time $\Delta t$ can be represented by:

$$T_{n+1}=T_r+\Sigma(T_k\times exp(-m_k\times\Delta t)+\Delta T_k) \quad (1)$$

$$T_n=\Sigma T_k+T_r \quad (2)$$

where $\Delta T_k$ is the amount of heat injected during the time $\Delta t$, and $T_k$ is the initial value for each value of k. Also $m_k$ is the reciprocal of the time constant determined by the component parts of the recording head unit. In case of the head unit explained above, there are defined following reciprocals of time constants:

$m_1=17.72$ ($sec^{-1}$)

$m_2=2.49$ ($sec^{-1}$)

$m_3=0.17$ ($sec^{-1}$)

As will be apparent from the foregoing equations, $exp(-m_k\times\Delta t)$ approaches zero in about 20 seconds in case of k=1 or 2. Consequently, the aforementioned drawback that the indicated temperature corresponding to the room temperature cannot be immediately obtained in case of replacement of the recording head cartridge needs only to be considered for k=3.

In case of k=3, if no current is supplied in the recording head ($\Delta T_3=0$), there stands following equation for head temperatures $T_1$, $T_2$ detected by the diode sensor respectively at certain times $t_1$, $t_2$ ($t_2>t_1$). More specifically, by substituting $\Delta t=t_2-t_1$ and n=1 in the equations (1) and (2) and also setting a temperature $T_r$ converted from the output of the diode sensor at the room temperature as $T_{init}$ therein, and erasing $\Sigma T_k$ or $T_3$ from these equations, there is obtained:

$$T_2-T_{init}=(T_1-T_{init})\times exp(-m_3\times(t_2-t_1)) \quad (3)$$

From this equation (3), the temperature $T_{init}$ converted from the output of the diode sensor of the recording head at the room temperature is given by:

$$T_{init} = T_1/(1-\exp(m\times(t_2-t_1)) + T_2/(1-\exp(-m\times(t_2-t_1)) \quad (4)$$

It will be apparent from the equation (4) that $T_{init}$ can be obtained by multiplying $T_1$ and $T_2$ with constants if the interval ($\Delta t=t_2-t_1$) of the measurements by the diode sensor is maintained constant, as represented by:

$$T_{init} = T_1\times A + T_2\times B \quad (5)$$

$$A = 1/(1-\exp(m\times\Delta t))$$

$$B = 1/(1-\exp(-m\times\Delta t))$$

It is therefore possible to estimate the temperature $T_{init}$, converted from the output of the diode sensor at the room temperature, in the main body of the recording apparatus by determining the constants A, B by measurements in advance and fetching the temperature with the diode sensor at thus determined interval $\Delta t$. Thus estimated values enables the detection of the head temperature by the prior technology explained in the foregoing, and also enables the drive and temperature control of the recording head.

[5th Embodiment]

In contrast to the foregoing 4th embodiment in which the temperature converted from the output of the diode sensor of the recording head is obtained from the calculations of the equations (5) involving the constants A, B, the present embodiment is to reduce the burden of said calculations by the use of a table.

A matrix table, for referring to the equations (5) with $T_1$ and $T_2$, will require a large capacity. On the other hand, by considering the difference between $T_1$ and $T_2$, or the descent of the head temperature as $\Delta T$ ($=T_1-T_2$), there is obtained a relation A+B=1, so that the equations (5) can be reduced to:

$$T_{init}=T_2+A\times\Delta T \quad (6)$$

Thus there can be prepared a table in which $\Delta T$ and $A\times\Delta T$ have one-to-one correspondence.

Figure 12:
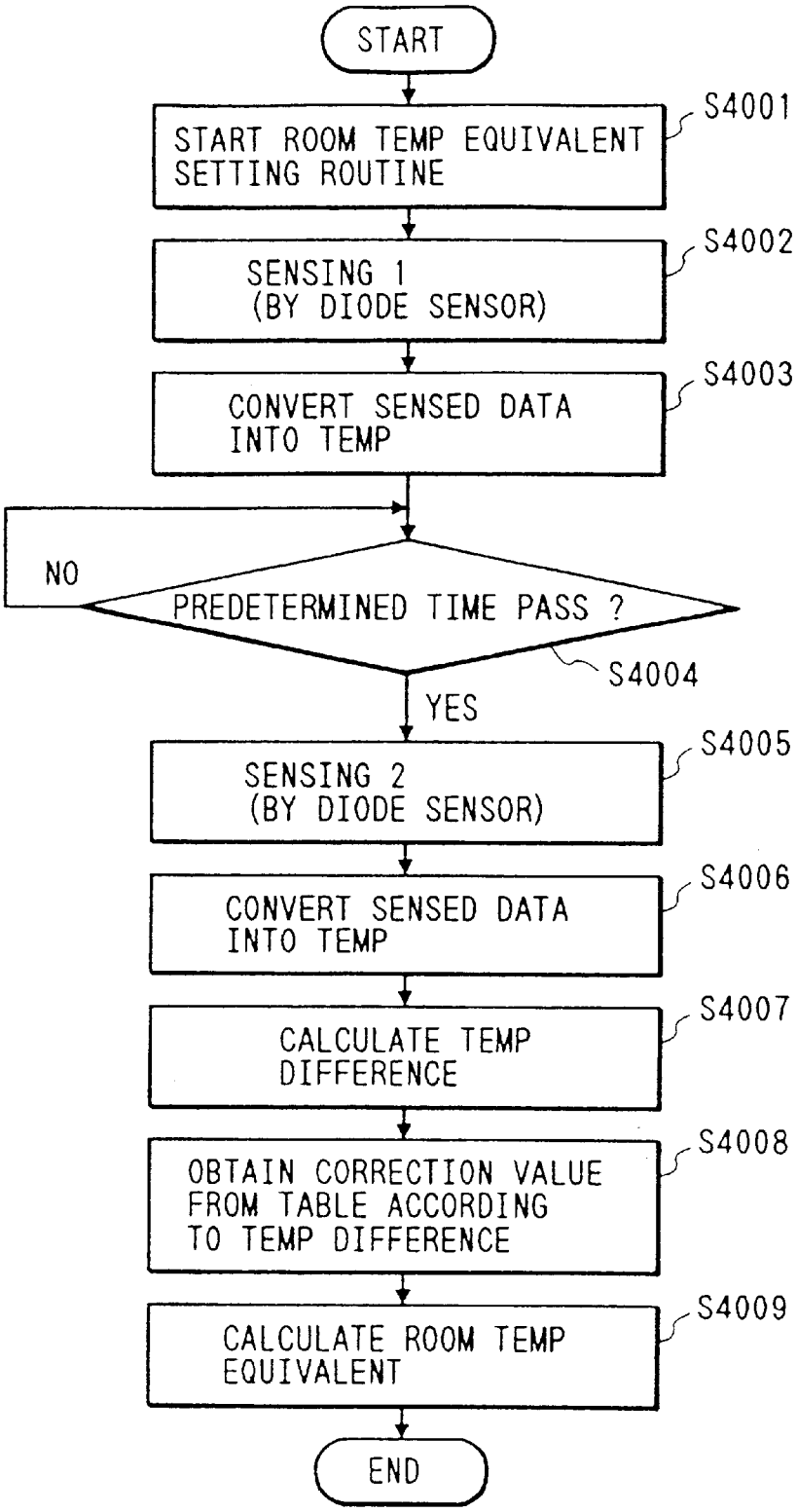
FIG. 12 is a flow chart showing the temperature estimating sequence for the recording head in a fifth embodiment of the present invention.

FIG. 12 shows a sequence for determining the converted temperature, utilizing the above-explained table.

When the room temperature setting routine is started at a step S4001, the value detected by the diode sensor of the recording head is fetched twice (S4002, S4005) with a predetermined interval (S4004), and is converted to the temperature (S4003, S4006). Then the difference $\Delta T$ of thus converted temperatures is calculated (S4007), and the correction value $A\times\Delta T$ is obtained from the table (S4008). Finally said correction value $A\times\Delta T$ is added to the converted temperature $T_2$ fetched second time to obtain the converted temperature $T_{init}$ obtained by the diode sensor of the recording head at the room temperature (S4009).

This embodiment enables the use of table instead of calculation, thereby reducing the burden thereof. Other effects are same as those of the 4th embodiment.

[6th Embodiment]

The foregoing embodiments can handle only one thermal time constant, but there may be required to consider plural thermal time constants, depending on the configuration of the recording head and on the timing of data fetching by the diode sensor. The present embodiment enables determination of the converted temperature $T_{init}$ by the diode sensor of the recording head at the room temperature, in consideration of plural thermal time constants.

As in the foregoing embodiment, the heaters are not powered during the data fetching by the diode sensor, so that the equation (1) becomes:

$$T_{n+1}=T_{init}+\Sigma(T_j\times exp(-m_j\times\Delta t)) \quad (7)$$

In case the head temperature is fetched plural times by the diode sensor with a constant interval, the value indicating the head temperature can be represented by:

$$T_n=T_{init}+\Sigma(T_j\times exp(-(n-1)\times m_j\times\Delta t)) \quad (8)$$

wherein n indicates the number of times of the head temperature fetching. Unknown in this equation are the desired converted temperature $T_{init}$ and the initial value $T_j$ for each j, so that there are (j+1) unknown parameters for j thermal time constants $m_j$. Thus, for determining $T_{init}$, there are obtained (j+1) simultaneous equations (8) by fetching the head temperature (j+1) times at a constant interval. Stated differently, the temperature $T_{init}$ converted from the reading of the diode sensor of the recording head corresponding to the room temperature is given by:

$$T_{init}=a_1\times T_1+a_2\times T_2+\ldots+a_n\times T_n \quad (9)$$

(n=j+1)

wherein parameters $a_n$ can be easily determined mathematically.

It is thus rendered possible to determine the temperature converted from the reading of the diode sensor of the recording head, corresponding to the room temperature, by fetching the head temperature $T_n$ with the diode sensor plural times at a constant interval and by setting parameters $a_n$ in advance in the main body of the recording apparatus, so as to enable calculation in the form of the equation (9).

This method also enables to determine the initial values of the recording head temperature relating to the thermal time constants $m_j$, or the temperature variations $T_j$. It will also be apparent that the intervals of plural data fetchings need not necessarily be constant if they are defined in advance.

As explained in the foregoing, the 4th to 6th embodiments of the present invention fetch the value, detected by the temperature sensor provided on the recording head, at least twice with a predetermined interval, at the mount of the recording head or in an equivalent state, and determine the detected value of the temperature sensor, corresponding to a predetermined surrounding temperature, from the trend of thus fetched values, thereby allowing to estimate the head temperature.

As a result, it is rendered possible, in case the recording head is replaced, to promptly determine the estimated temperature of the recording head and to effect appropriate drive or temperature control of the recording head, according to the temperature thereof.

[7th Embodiment]

Figure 13:
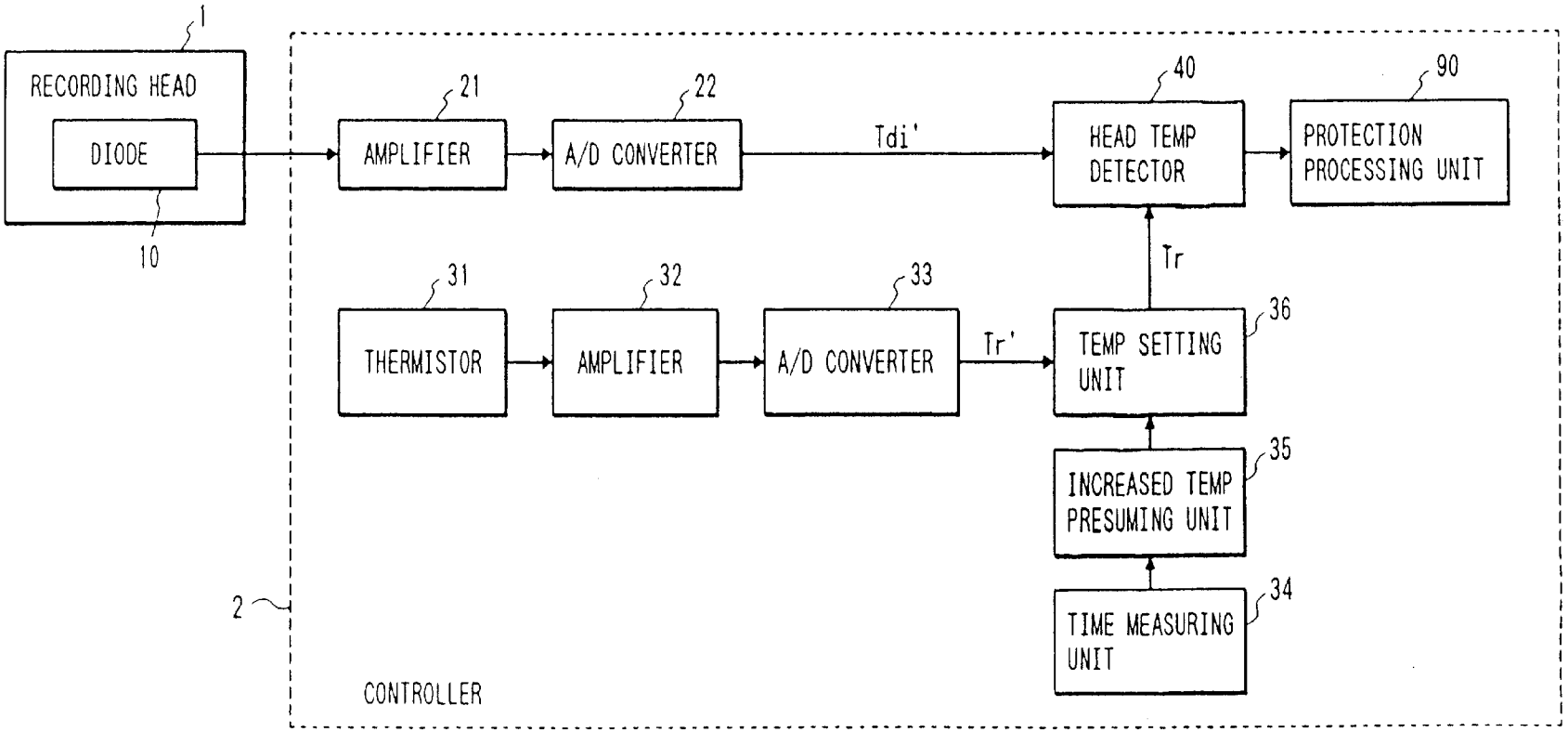
FIG. 13 is a block diagram of a temperature detecting mechanism of said embodiment.

In this embodiment there will be explained a mechanism for detecting the head temperature with a diode sensor provided on the recording head, and a mechanism for detecting the surrounding temperature with a thermistor. The apparatus and circuit configuration of the present embodiment are same as those in the foregoing 1st to 3rd embodiments. FIG. 13 is a block diagram of the temperature detecting mechanism of the present embodiment, which will be explained in the following. A diode sensor 10 generates an electrical signal corresponding to the temperature of the recording head 1. The voltage from the diode sensor 10 is amplified by an amplifier 21, and is digitized to Tdi' by an A/D converter 22. Thus obtained value is converted into a temperature by a software executed by an MPU 1701.

The surrounding temperature detecting mechanism is constructed in the following manner. A thermistor 31 is provided on a circuit board of the control unit 2 in the main body of the recording apparatus, and the voltage from the thermistor 31, corresponding to the detected temperature, is amplified by an amplifier 32. The amplified voltage is then digitized by an A/D converter 33 to obtain a detected temperature value Tr'. Also following configuration is provided in order to consider the influence of heat-generating components present on said circuit board to the thermistor 31. A timer unit 34 administers the on and off times of the power supply to said heat-generating components. A temperature rise estimation unit 35 estimates the temperature rise of the circuit board, based on the above-mentioned on/off times, and a temperature setting unit 36 determines the surrounding ambient temperature Tr by subtracting the temperature rise of the circuit board from the temperature Tr' indicated by the thermistor.

The head temperature Tdi' and the surrounding temperature Tr, obtained as explained above, are supplied to a head temperature detection unit 40, which determines the recording head temperature by setting the offset value of the diode sensor 10 by means of the surrounding ambient temperature Tr, and correcting the head temperature Tdi'. The overheated state of the recording head is discriminated by said recording head temperature, and, if such overheated state is detected, a protection process unit 90 is activated.

In the following there will be explained the method for setting the offset value for the diode sensor 10 in the present embodiment. In the present embodiment, the offset value setting is achieved by setting of the temperature value indicated by the diode sensor 10 when the recording head 1 is at the room temperature, as will be explained in the following.

Figure 14:
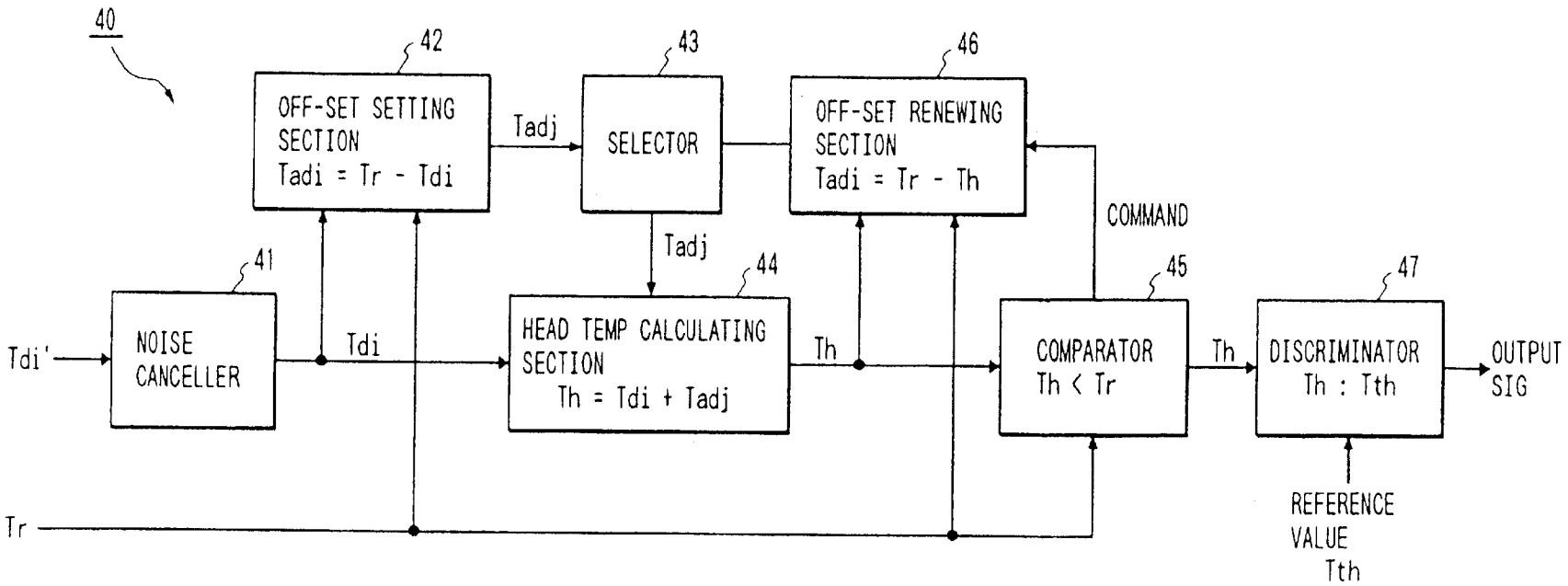
FIG. 14 is a block diagram showing the configuration and function of a head temperature detecting unit in said embodiment.

FIG. 14 is a block diagram showing the functional configuration of a heat temperature detecting unit 40 in the present embodiment.

At first the initial offset value of the diode sensor 10 of the recording head is set as the offset value Tadj. A noise canceller unit 41 effects noise cancellation (to be explained later) by software, on the input Tdi' from the diode sensor to obtain a detected temperature value Tdi. Then there is fetched the detected temperature value Tdi' of the diode sensor 10 at the recording head mounting or immediately after the start of power supply to the main body of the recording apparatus, and the temperature value Tdi obtained by the noise canceller unit 41 is supplied to an offset setting unit 42, which sets the initial offset value, based on the detected temperature value Tdi and the surrounding temperature Tr, obtained from the thermistor 21, according to:

$$Tadj=Tr-Tdi.$$

Thus set offset value is supplied, through a selector unit 43, to a head temperature calculating unit 44.

Figure 15:
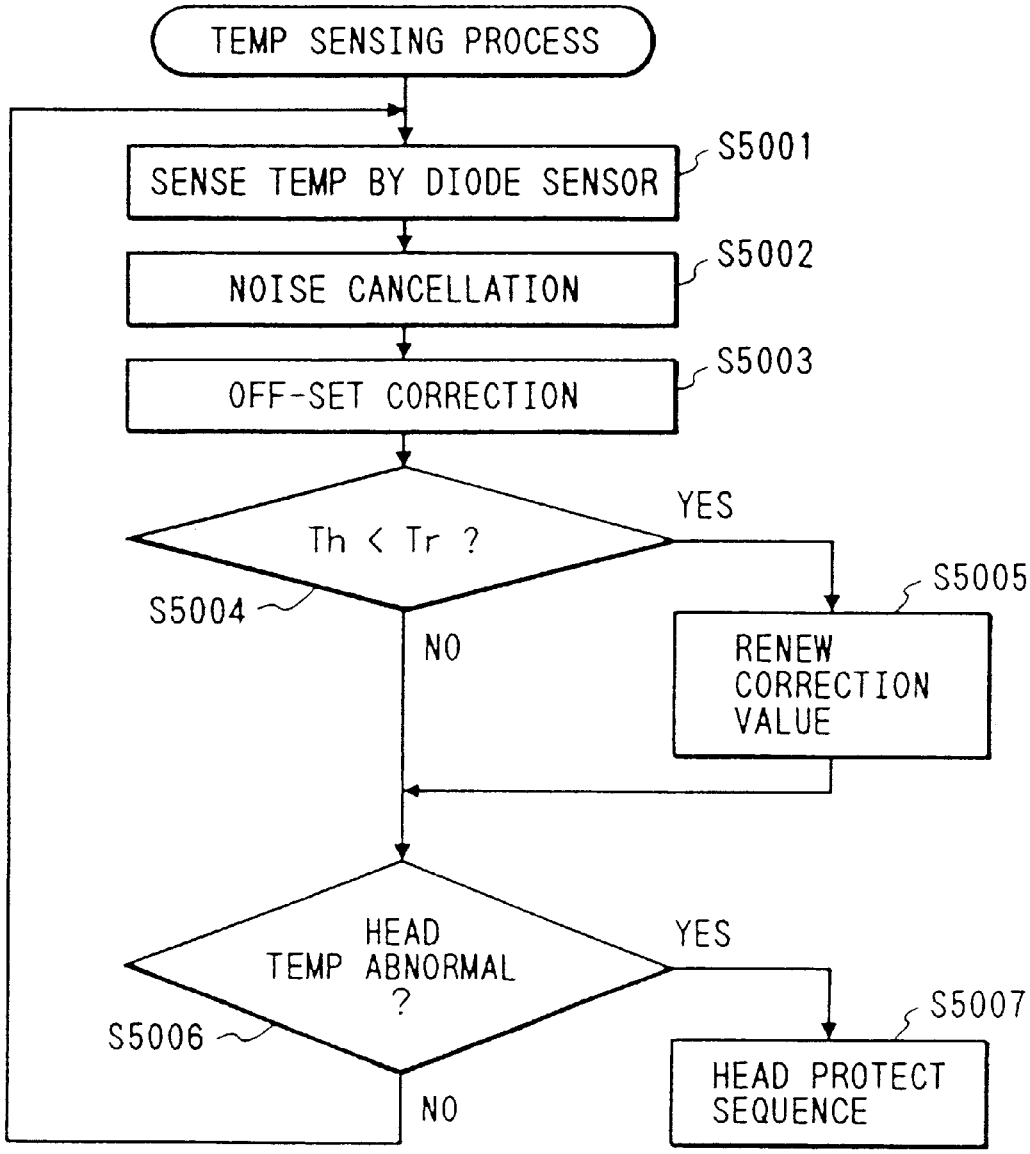
FIG. 15 is a flow chart showing the temperature detecting sequence for the recording head in a seventh embodiment.

The sequence, shown by a flow chart in FIG. 15, is executed, utilizing the initial offset value set as explained above. In the following there will be given an explanation on the flow chart shown in FIG. 15, including the functions of the components shown in FIG. 14.

At first a step S5001 causes the temperature detection means, utilizing the diode sensor 10, to obtain the temperature value Tdi' indicated by said diode sensor. Then a step S5002 causes the noise canceller unit 41 to effect the noise cancellation by software. For this purpose there have been proposed various methods, such as a method of determining the temperature value Tdi' of the diode sensor 10 from the moving average of a certain number of sampled values, or a method in which, in case the variation from the temperature previously indicated by the diode sensor 10 exceeds a predetermined range of variation, Tdi is selected within said range of variation. Then a step S5003 causes the head temperature calculating unit 44 to correct the offset value with respect to Tdi obtained in the step S5002, thereby determining the head temperature Th. Thus the head temperature calculating unit 44 effects a calculation:

$$Th=Tdi+Tadj$$

wherein the offset value Tadj is set in advance according to the above-explained process.

A next step S5004 compares the head temperature Th obtained by the head temperature calculating unit 44, with the surrounding temperature Tr, and, if:

$$Th<Tr$$

the sequence proceeds to a step S5005. In such case, it is assumed that the temperature of the recording head 1 was higher than the room temperature at the setting of the initial offset value Tadj, but the temperature of the recording head 1 has become lower. Thus a step S5005 renews the offset value of the diode sensor by:

$$Tadj=Tr-Th.$$

Referring to FIG. 14, a comparator 45 compares the head temperature Th with the surrounding temperature Tr, and, if Th<Tr, a renewal of the offset value is instructed to an offset renewal unit 46, which, in response, renews the offset value by Tadj=Tr−Th. The renewed offset value is set, through the selector unit 43, in the head temperature calculating unit 44 and is thereafter employed in the calculation.

The above-explained renewal process allows to bring the offset value to the ideal state, even when the head temperature is elevated at the replacement of the recording head or at the start of power supply to the recording apparatus, as the temperature of the recording head descends toward the surrounding ambient temperature while the recording operation is not conducted.

A next step S5006 causes a discriminator 47 to discriminate whether the obtained head temperature Th is abnormal. The head temperature is identified as abnormal if Th<Tth, wherein Tth is a predetermined limit temperature, and the sequence proceeds to a step S5007 for initiating a sequence for protecting the recording head from excessive temperature. Referring to FIG. 14 again, an output signal from the discriminator 47 activates the protection unit 90. Such protective sequence is already known in the recording technology utilizing the thermal head, and generally effects dissipation of the heat of the recording head, by inserting a pause between the main scanning operations of the recording head.

On the other hand, if the step S5006 identifies:

$$Th \leqq Tth,$$

the head temperature is considered within a range capable of ordinary recording operation, and the sequence returns to the step S5001. The above-explained process allows to achieve protection of the recording head and correction of the offset value of the diode sensor of the recording head.

As explained in the foregoing, the 7th embodiment enables to renew the offset value to an appropriate value even in case the temperature of the recording head is higher than the room temperature at the replacement of the recording head or at the start of power supply to the recording apparatus, thereby allowing to achieve proper protection of the recording head from overheating.

[8th Embodiment]

Figure 16:
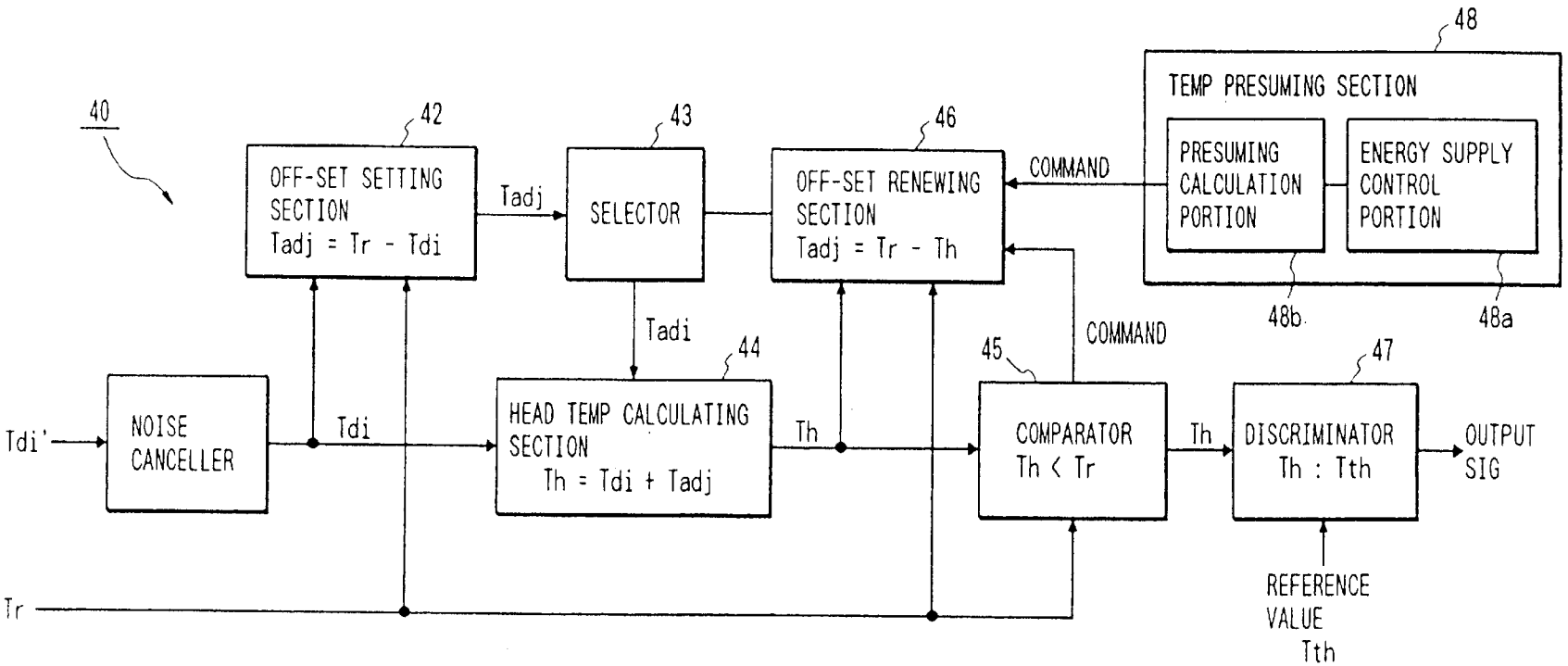
FIG. 16 is a block diagram showing the configuration and function of a head temperature detecting unit in an eighth embodiment.

In the following there will be explained another method for setting the offset value of the diode sensor, provided on the recording head, at the room temperature. The recording apparatus of this embodiment will not be explained as it is similar to that in the foregoing 1st to 3rd embodiments. FIG. 16 is a block diagram showing the functional configuration of the head temperature detecting unit in this 8th embodiment, in which, the head temperature detection unit 40 is provided with a temperature estimation unit 48 for estimating the temperature of the recording head. The details of said estimation will be explained in the following.

(Modelling of Recording Head)

The temperature detection of the recording head is conducted by employing calculational estimation based on the physical law of heat conduction, dividing the recording head into model groups, each having a practically same thermal conduction time constant, and calculationally estimating the temperature behavior in each of thus divided units. In the following there will be explained the details of division of the components of the recording head into model groups, each of a same time constant.

Figure 17:
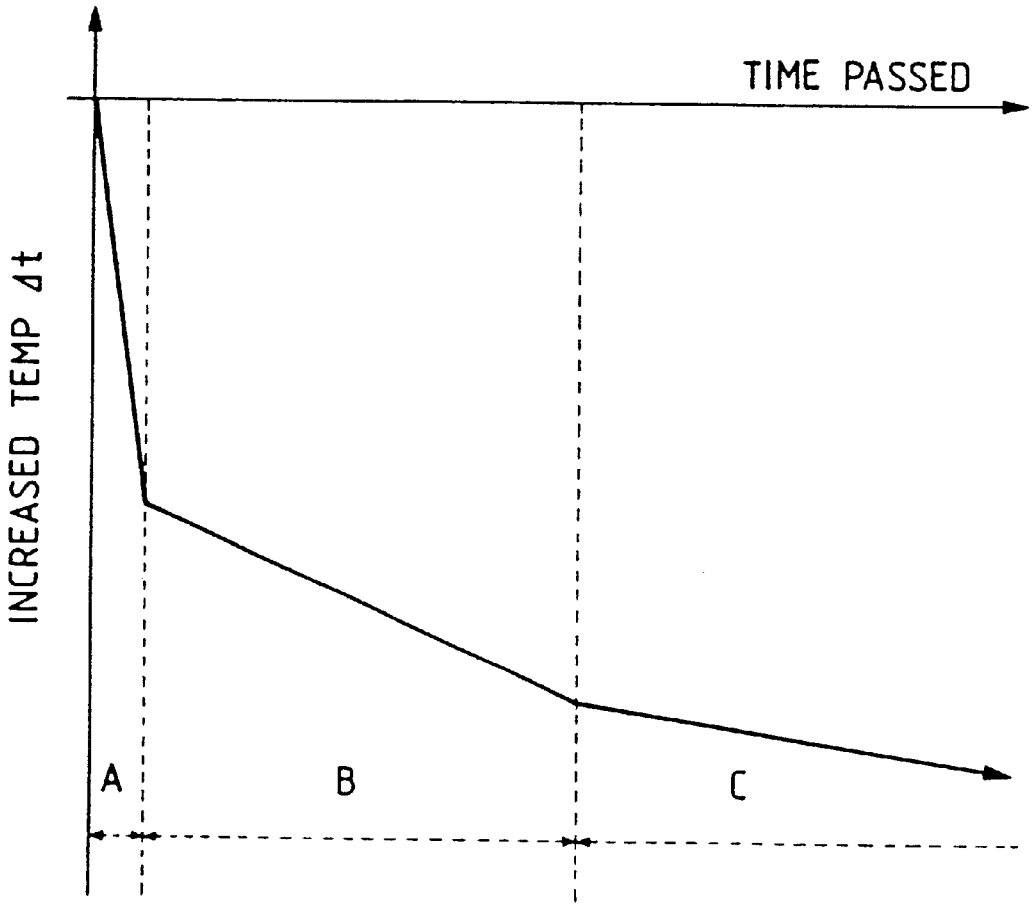
FIG. 17 is a chart showing the relationship between the time of energy input to the recording head and the temperature rise thereof.

The present inventors have obtained the results shown in FIG. 17, by supplying the recording head of the above-explained configuration with energy and sampling the data of temperature rise in the recording head. FIG. 17 shows the temperature rise of the recording head in the ordinate (represented by ln (1−Δt/a), wherein a stands for the equilibrium temperature) as a function of the elapsed time of energy supply in the abscissa.

Though the above-mentioned recording head 1 is composed, strictly speaking, of a combination of various components of different thermal conductivities, FIG. 17 indicates that said recording head can be regarded as a single component in thermal conduction, within a range in which the temperature rise, logarithmically converted as explained above, has a constant differential value with respect to the elapsed time (more specifically within each of the ranges A, B and C in FIG. 17, in which the slope of curve is constant). It is thus possible to estimate the temperature behavior of the recording head, by determining the heat conduction in each unit that can be regarded as a single heat-conducting member.

Based on the foregoing, the present 8th embodiment adopts two thermal time constants in dealing with the thermal conduction model of the recording head. (Though the foregoing results indicate that more exact regression can be achieved with a model involving three thermal time constants, the present embodiment a model of the recording head involving two thermal time constants, considering that the areas B and C in FIG. 17 have a same slope of curve and giving emphasis on the efficiency of temperature detection.)

Figures 18, 19:
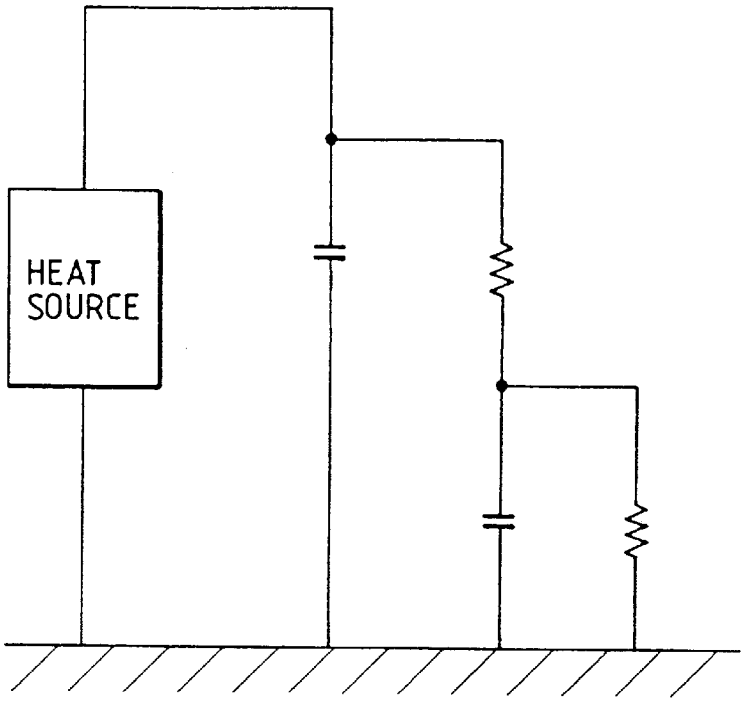
FIG. 18 is an equivalent circuit diagram of a heat conduction model of the eighth embodiment.
FIG. 19 is a chart showing allowable calculation interval and data holding time for a short-range time constant group and a long-range time constant group.

In more specific numerical terms, there are employed a heat conduction model with a time constant of temperature rise of reaching the equilibrium temperature in 0.8 seconds (corresponding to the area A in FIG. 17), and a heat conduction model with a time constant reaching the equilibrium temperature in 512 seconds (corresponding to the areas B and C in FIG. 17). In the following detailed description of the 8th embodiment, the components represented by said area A will be called the short-range time constant group, while those represented by the areas B and C will be called the long-range time constant group. FIG. 18 shows an equivalent circuit of the heat conduction in such modeling.

[Calculation of Temperature Behavior in Each Time Constant Group]

In the present embodiment, for estimating the temperature of each time constant group of the recording head, there are employed the following physical equations of thermal conduction:

in case of heating:

$$\Delta temp = a\{1 - exp[-m \times T]\} \tag{1}$$

in case of cooling from the middle of heating:

$$\Delta temp = a\{exp[-m(T - Tl)] - exp[-m \times T]\} \tag{2}$$

wherein:

temp: raised temperature of object a: equiliblized temperature of object reached by heat source T: elapsed time m: thermal time constant of object Tl: time of removal of heat source.

In the recording apparatus of the present embodiment, the discharge heater constituting the heat source is turned on and off at the maximum driving frequency, but there is defined a unit time as will be explained later and the temperature is calculated from the energy supplied per said unit time. Also the present embodiment reduces the burden of the calculation by employing an algorithm in which the above-explained general equation of thermal conduction is developed in the following manner.

[Example of Temperature Estimation after a Time nt from the Activation of the Heat Source]

In the following there will be explained the method employed in the present embodiment, for estimating the temperature after a time nt from the activation of the heat source.

The foregoing equation (1) is developed in the following manner:

$$\begin{aligned} a\{1 - \exp[-m*n*t]\} &= a\{\exp[-m*t] - \exp[-m*t] + \exp[-2*m*t] - \exp[-2*m*t] + \ldots + \exp[-(n-1)*m*t] - \exp[-(n-1)*m*t] + 1 - \exp[-n*m*t]\} \\ &= a\{1 - \exp[-m*t]\} + a\{\exp[-m*t] - \exp[-2*m*t] + a\{\exp[-2*m*t] - \exp[-3*m*t]\} \ldots + a\{\exp[-(n-1)*m*t] - \exp[-n*m*t]\} \end{aligned} \tag{1'}$$

$$= a\{1 - \exp[-mt]\} + \tag{2-1}$$

$$a\{\exp[-m*(2t-t)] - \exp[-m*2t]\} + \tag{2-2}$$

-continued $$a\{\exp[-m*(3t-t)] - \exp[-m*3t]\} \tag{2-3}$$

$$\ldots +$$

$$a\{\exp[-m*(nt-t)] - \exp[-m*nt]\} \tag{2-n}$$

Through this development, the equation (1) becomes equal to (2-1)+(2-2)+(2-3)+ . . . +(2-n), wherein:

term (2-n) corresponds to the temperature of object at a time nt when heating is turned on from time 0 to t and turned off from time t to tn;

term (2-3) corresponds to the temperature of object at a time nt when heating is turned on from time (n−3)t to (n−2)t and turned off from time (n−2)t to nt;

term (2-2) corresponds to the temperature of object at a time nt when heating is turned on from time (n−2)t to (n−1)t and turned off from time (n−1)t to nt; and term (2-1) corresponds to the temperature of object at a time nt when heating is turned on from time (n−1)t to nt.

The fact that the sum of the foregoing terms is equal to the equation (1) indicates that the current temperature (temperature rise) of the object can be estimated by determining the magnitude of descent, in each unit time, of the object temperature raised by the energy supplied in the unit time t (corresponding to each of the terms (2-1), (2-2), . . . , (2-n)) and calculating the sum of magnitudes of descent of the object temperature raised in the past unit time.

For executing this calculation, it is necessary to set a "data holding time" required for the temperature rise Δt, attained in said unit time, to return to zero (Δt=0) and an "allowable calculation interval" in which the error, resulting from discrete estimation of ascent and descent of continuously varying temperature, is allowed.

In the present embodiment, the calculation for the temperature behavior of each time constant group of the recording head is executed by selecting the "data holding time" and the "allowable calculation interval" as shown in FIG. 19, which shows the numerical values of these parameters for the short-range and long-range time constant groups.

[Detection of Temperature Behavior for Each Time Constant Group]

Based on the division of time constants of the recording head and on the setting of the calculation interval and the data holding time for each time constant group explained above, the recording head temperature can be estimated by calculation according to the foregoing equation. However, the MPU cannot directly execute an exponential calculation in general. Consequently this calculation has to be conducted by approximation, or by obtaining exponential values from a conversion table, thus requiring a long processing time.

For avoiding this difficulty, the present 8th embodiment adopts a method of executing calculations for all the possible values in advance and storing thus prepared calculation table in a memory. For example the energy suppliable per unit time (from 0 to 100%) is divided into 40 divisions of 2.5% each, and the actually supplied energy is approximated to one of such 40 divisions. For example, supplied energy at least equal to 0% but less than 2.5% is approximated by the 1st division, and supplied energy at least equal to 2.5% but less than 5% is approximated by the 2nd division. In this manner the supplied energy from 0 to 100% is approximated by one of 40 divisions. Also the temperature ascent/descent characteristics are calculated in advance for each of the divisions of the supplied energy.

For the short-range time constant group for which the calculation interval is 0.05 seconds and the data holding time is 0.8 seconds as explained above, there are calculated 16 data (=0.8/0.05) of temperature descent at intervals of 0.05 seconds each and for a total time of 0.8 seconds, and 640 (=40 divisions×16) temperature descent data for each division are stored in a calculation table (connected to an estimation calculation unit 48*b* shown in FIG. 16) (not shown). In this manner the temperature behavior of the short-range time constant group can be determined by reference to the table. For the long-range time constant group, 512 data (=512/1) are calculated for each division of 2.5% of the supplied energy, and 20480 (=40 divisions×512) data in total are stored in the calculation table. Thus the temperature behavior of the long-range time constant group can be determined by reference to the table.

However, in the long-range time constant group, the temperature change is extremely slow, and, with the lapse of time after the energy supply, the temperature change in 1 second becomes so small as to be comparable to the error. Consequently, in the present embodiment, the memory capacity is economized by storing, instead of the calculated data of 512 divisions of 1 second each, data of 14 intervals up to 1, 3, 5, 7, 9, 11, 21, 41, 61, 81, 101, 151, 301 and 512 seconds, thereby forming a calculation table of 560 (=40 divisions x 14) data in total.

[Estimation of Recording Head Temperature]

The above-explained process is executed by the temperature estimation unit 48 in FIG. 16. The energy supply control unit 48*a* detects the energy supplied per unit time (0–100%), and supplies the estimation calculation unit 48*b* with said energy value in each unit time. The estimation calculation unit 48*b* detects the temperature rise by the energy supply in each unit time and the magnitude of temperature descent at the time of temperature estimation, by reference to the table, and effects temperature estimation by successive accumulation of thus detected temperatures.

More specifically, for the short-range time constant group, the temperature rise by the activation of the ink discharge heaters can be calculationally determined, by detecting the magnitude of descent, at the time of estimation, of the temperature raised in each unit time by reference to the table and accumulating thus detected temperatures at the intervals of 0.05 seconds each. Similarly, for the long-range time constant group, the temperature rise by the activation of the ink discharge heaters can be determined by detecting the magnitude of descent, at the time of estimation, of the temperature raised in each unit time and accumulating thus detected temperatures at the intervals of 1 second each.

Thus the recording head temperature can be determined by detecting the temperature rise for each of the model time constant groups defined in the recording head, and calculating the sum of the calculated temperature rises of said time constant groups.

It is thus rendered possible to detect the temperature of the recording head by determining the temperature rise for each of the model time constant groups, defined by thermal conductivities in the recording head, and calculating the sum of the determined temperature rises of said time constant groups.

A technology similar to the above-explained temperature calculating method is disclosed for example in the Japanese Patent Laid-open Application No. 5-208505.

[Renewal of Reference Value of Head Diode Sensor]

Figure 20:
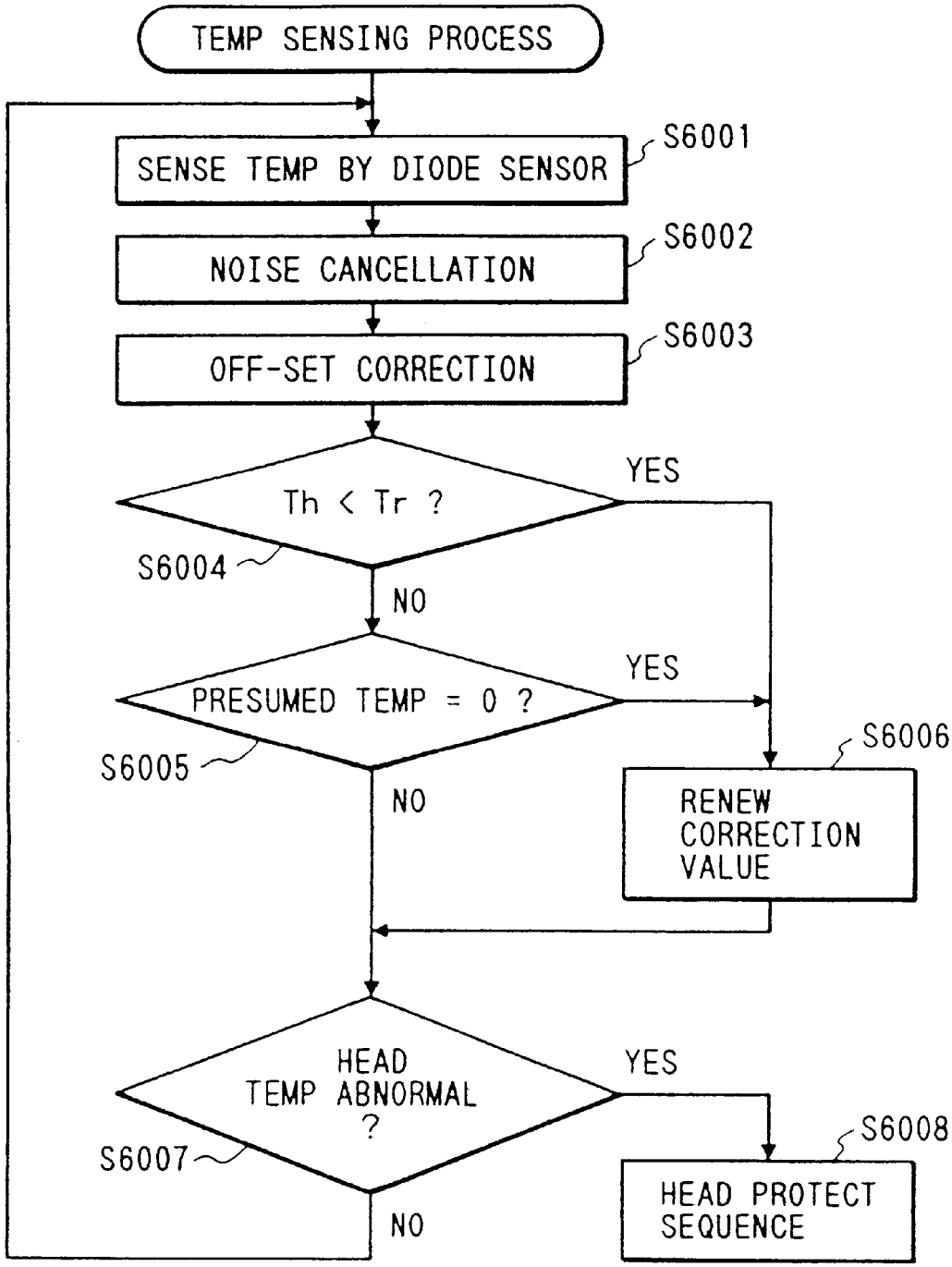
FIG. 20 is a flow chart showing the temperature detecting sequence for the recording head of the eighth embodiment.

In the following there will be explained; with reference to FIG. 20, another method for setting the temperature indication value of the diode sensor, at the room temperature, of the recording head utilizing the aforementioned temperature estimation. In FIG. 20, steps S6001, S6002, S6003, S6004, S6006, S6007 and S6008 are respectively equivalent, in the 7th embodiment, to the steps S5001, S5002, S5003, S5004, S5005, S5006 and S5007.

In this 8th embodiment, if the step S6005 identifies that the head temperature, estimated by the temperature estimation unit 48, is zero, the sequence proceeds to the step S6006 for renewing the offset value of the diode sensor. In case the estimated temperature of the recording head is "zero", the temperature estimation unit 48 sends, to the offset renewal unit 46, an instruction to renew the offset value.

As explained in the foregoing, in the 8th embodiment, the temperature estimation unit 48 judges the time when the influence of heat, supplied to the recording head from immediately after the mounting thereof or from immediately after the start of power supply to the recording apparatus. Therefore, if the head temperature is already raised at the mounting of the recording head or at the start of power supply to the recording apparatus, the head temperature becomes closer, from the initial head temperature, to the surrounding temperature, by the time elapsed until zero estimated temperature of the recording head is reached.

The above-explained configuration realizes secure renewal of the offset value even in case the recording head is mounted with a head temperature lower than the surrounding temperature (situation not considered in the 1st embodiment). For example, if the ink jet recording apparatus is moved from a location of a low temperature to another location of a higher temperature, the temperature of the recording head may become lower than the surrounding temperature. The 8th embodiment achieves secure renewal of the offset value even in such case.

The 8th embodiment also provides an advantage of obtaining the offset value stabler to the variation of the room temperature, since the renewal of the offset value is conducted according to the surrounding temperature when the thermal influence of the ink discharge heaters is eliminated.

[9th Embodiment]

The present 9th embodiment is featured, in addition to the sequence explained above, by providing a limit for the correction value, in correcting the offset value of the head diode sensor. The configuration of the 9th embodiment is similar to that of the foregoing 7th and 8th embodiments, and will not, therefore, be explained further. In the following there will be explained the function of the offset renewal unit 46 in this 9th embodiment.

In the foregoing 7th and 8th embodiments, the overall precision of detection is represented by ±(Ter1+Ter2), wherein ±Ter1 is the precision of detection of the surrounding temperature and ±Ter2 is the precision of detection in consideration of the fluctuation of the diode sensor and the error in the circuitry. According to the measurement by the present inventors, the above-mentioned overall error was ±22° C. Also in the normal use, the maximum temperature of the recording head is about 80° C.

Immediately after the replacement of the recording head or after the start of power supply to the recording apparatus, the head temperature may reach about 80° C., and, in case the surrounding temperature is 23° C., the correction value becomes −57° C. Consequently the offset value for the head diode sensor may become larger than the above-mentioned overall error, or +22° C.

Therefore, in this 9th embodiment, the correction value Tadj for the diode sensor is given upper and lower limits, in the steps S5005 and S5006 for renewing the correction value. More specifically, if the offset renewal unit identifies:

$$Tadj<-(Ter1+Ter2),$$

there is set:

$$Tadj=-(Ter1+Ter2).$$

Also in case there is identified:

$$Tadj>(Ter1+Ter2),$$

there is set:

$$Tadj=(Ter1+Ter2).$$

As explained in the foregoing, this 9th embodiment prevents setting of an unnecessarily large offset value. Consequently there can be prevented a drawback that the head temperature Th is detected significantly lower than the actual value because of the unnecessarily large offset value, whereby the overheated state of the recording head is overlooked.

Also in a system controlling the ink discharge energy according to the temperature of the recording head, the ink discharge amount can be appropriately controlled since there can be prevented a situation where the recording head temperature is detected significantly lower than the actual temperature.

The foregoing embodiments have shown preferred application of the present invention to the ink jet recording apparatus with replaceable recording head, in which the temperature of the recording head is rendered detectable, but the application of the present invention is not limited to such embodiment. For example it is naturally applicable to the recording head of thermal system.

Also the present invention is applicable not only to an apparatus consisting of a single equipment but also to a system consisting of plural equipment. Furthermore, the present invention is naturally applicable also to a case in which the process defined by the present invention is achieved by providing a system or an apparatus with a program for executing said process.

As explained in the foregoing, the present invention enables to improve, in an ink jet recording apparatus, the precision of detection of the temperature around the recording head with the lapse of time, even if the temperature of the recording head is elevated.

More specifically, the present invention enables to decrease the detection error in the detection means for the recording head temperature with the lapse of time, by renewing in succession the correction value in the detection of the recording head temperature, thereby obtaining the temperature of the recording head with a practically acceptable precision.

It is also possible to avoid the waiting time inconvenient for the user, because an appropriate offset value can be selected even when the recording head is replaced after heating thereof or when the power supply of the recording apparatus is repeatedly turned on and off.

Also in another configuration of the present invention, an exact offset value can be given with a relatively high probability from the start of the measurement of the recording head temperature, since the initial offset value is set at a timing of high probability that the recording head is in thermal equilibrium with the ambience.

Also in still another configuration of the present invention, if the head temperature is detected lower than the surrounding temperature, the offset value is renewed with the difference of said surrounding temperature and said head temperature. It is therefore rendered possible, with a relatively simple structure, to bring the offset value closer to the correct value in the repetition of the measurement of the recording head temperature. Particularly the offset value can be effectively made closer to the correct value, in case the recording head temperature is higher than the surrounding temperature at the setting of the offset value by the setting means.

Also in still another configuration of the present invention, the offset value is so corrected that the detected head temperature becomes substantially equal to the surrounding temperature, at a timing when the thermal influence for example of the applied ink discharge energy is estimated to no longer exist, so that the correction of the offset value can be achieved more effectively and more exactly.

Also in still another configuration of the present invention, the offset value is renewed with certain limits, in order to prevent drawback resulting from the setting of an excessively large offset value. For example there can be prevented a drawback that an excessively large negative offset value lowers the detected temperature of the recording head, whereby the overheated state thereof is overlooked.

Also in still another configuration of the present invention, appropriate protection is provided in case of overheating of the recording head, thereby preventing breakage thereof.

Also in still another configuration of the present invention, more precise temperature control is rendered possible for the recording head of ink jet system.

Also in still another configuration of the present invention, the appropriate setting and renewal of the offset value facilitate the use of inexpensive diode sensor of excellent response in the temperature detection of the recording head.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in the U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the formation, expansion and contraction of the bubble, the liquid (ink) is ejected through a discharge opening to produce at least one droplet. The driving signal is preferably in the form of a pulse, because the expansion and contraction of the bubble can be effected instantaneously, and therefore, the liquid (ink) is discharged with quick response. The driving signal in the form of the pulse is preferably such as disclosed in the U.S. Pat. Nos. 4,463,359 and 4,345,262. In addition, the temperature increasing rate of the heating surface is preferably such as disclosed in the U.S. Pat. No. 4,313,124.

The structure of the recording head may be as shown in the U.S. Pat. Nos. 4,558,333 and 4,459,600 wherein the heating portion is disposed at a bent portion, as well as the structure of the combination of the discharge opening, liquid passage and the electrothermal transducer as disclosed in the above-mentioned patents. In addition, the present invention is applicable to the structure disclosed in Japanese Laid-open Patent Application No. 59-123670 wherein a common slit is used as the discharge opening for plural electrothermal transducers, and to the structure disclosed in Japanese Laid-open Patent Application No. 59-138461 wherein an opening for absorbing pressure wave of the thermal energy is formed corresponding to the discharging portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary discharge (not for the recording operation) can stabilize the recording operation.

As regards the variation of the recording head mountable, it may be single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized discharge in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, by the application of the recording signal producing thermal energy, the ink is liquefied, and the liquefied ink may be discharged. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus for effecting recording with a recording head on a recording medium, comprising:

a temperature detector provided on a control circuit board of said recording apparatus and adapted to detect a surrounding temperature at a position of the control circuit board;

a timer adapted to measure a first activation time of electric power supply to the control circuit board for a control not involving control of a recording operation; and a determination unit adapted to determine a timing of reading the surrounding temperature detected by said temperature detector and adapted to determine a correction value for correcting a thus read value, according to the first activation time measured by said timer.

2. A recording apparatus according to claim 1, wherein said timer is constructed to measure, after electric power supply to the control circuit board for a control involving control of a recording operation, a second activation time of electric power supply to the control circuit board for a control not involving the control of the recording operation; and wherein said determination unit is constructed to determine the timing of reading the surrounding temperature detected by said temperature detector and is constructed to determine a correction value for correcting a thus read value, according to the second activation time.

3. A recording apparatus according to claim 2, wherein said correction value is not selected as zero only if said second activation time is equal to or longer than a predetermined time.

4. A recording apparatus according to claim 3, wherein the predetermined time is a time required by the control circuit board, after temperature rise thereof by the electric power supply for said] a control involving the control of the recording operation, to show a temperature decrease corresponding to the temperature rise.

5. A recording apparatus according to claim 4, wherein said recording head includes a bubble generator constructed to generate a bubble in ink by thermal energy, and an ink discharger constructed to effect ink discharge as a result of formation of the bubble.

6. A recording apparatus according to claim 1, wherein the correction value is not selected as zero only if the first activation time is equal to or longer than a predetermined time.

7. A recording apparatus according to claim 6, wherein the predetermined time is a time required by the control circuit board to reach a saturated temperature rise, by the electric power supply, for a control not involving the control for the recording operation.

8. A recording apparatus according to claim 7, wherein the recording head includes a bubble generator constructed to generate a bubble in ink by thermal energy, and an ink discharger constructed to effect ink discharge as a result of formation of the bubble.

9. A recording apparatus according to claim 1, wherein said determination unit determines a correction value directly in accordance with the measured first activation time.

10. A temperature detecting method for a recording apparatus, for effecting recording with a recording head on a recording medium, the apparatus including a temperature detector provided on a control circuit board of the recording apparatus, said method comprising the steps of:

measuring a first activation time for electric power supply to the control circuit board for a control not involving control of a recording operation; and determining a timing of reading a surrounding temperature detected by the temperature detector and determining a correction value for correcting a thus read temperature, according to the measured first activation time.

11. A temperature detecting method according to claim 10, wherein said time measuring step includes measuring after electric power supply to the control circuit board for a control involving control of a recording operation, a second activation time of electric power supply to the control circuit board for a control not involving the control of the recording operation; and wherein said determining step includes determining a timing of reading the surrounding temperature detected by the temperature detector and determining a correction value for correcting a read temperature, according to the second activation time.

12. A temperature detecting method according to claim 11, wherein the correction timing is not selected as zero only if the second activation time is equal to or longer than a predetermined time.

13. A temperature detecting method according to claim 12, wherein the predetermined time is a time required by the control circuit board, after temperature rise thereof by the electric power supply for a control involving the control of the recording operation, to show a temperature decrease corresponding to the temperature rise.

14. A temperature detecting method according to claim 13, wherein the recording head includes a bubble generator constructed to generate a bubble in ink by thermal energy, and an ink discharger constructed to effect ink discharge as a result of formation of the bubble.

15. A temperature detecting method according to claim 10, wherein the correction value is not selected as zero only if the first activation time is equal to or longer than a predetermined time.

16. A temperature detecting method according to claim 15, wherein the predetermined time is a time required by the control circuit board to reach a saturated temperature rise, by the electric power supply, for a control not involving the control for the recording operation.

17. A temperature detecting method according to claim 16, wherein the recording head includes a bubble generator constructed to generate a bubble in ink by thermal energy, and an ink discharger constructed to effect ink discharge as a result of formation of the bubble.

18. A temperature detecting method according to claim 10, wherein said determining step includes determining a correction value directly in accordance with the measured first activation time.

19. A recording apparatus for effecting recording with a recording head on a recording medium, comprising:

a temperature detector provided on a control circuit board of said recording apparatus and adapted to detect a surrounding temperature at a position of the control circuit board;

elapsed time measuring means for measuring an elapsed time from a completion of previous recording; and means for determining a correction value for correcting the surrounding temperature detected from said temperature detector in accordance with the elapsed time measured by said elapsed time measuring means;

means for determining an acquiring timing of the surrounding temperature by said temperature detector in accordance with a detection result of said elapsed time measuring means.

20. A recording apparatus according to claim 19, wherein the recording head includes a bubble generator constructed to generate a bubble in ink by thermal energy, and an ink discharger constructed to effect ink discharge as a result of formation of the bubble.

21. A temperature detecting method for a recording apparatus, for effecting recording with a recording head on a recording medium, the apparatus including a temperature detector provided on a control circuit board of the recording apparatus, said method comprising the steps of:

measuring an elapsed time from completion of a previous recording;

determining a correction value to correct the surrounding temperature detected from said temperature detector in accordance with the elapsed time measured;

determining an acquiring timing of the surrounding temperature in accordance with a detection result of said elapsed time in said measuring step.

* * * * *

UNITED STATES PATENT AND TRADEMARK OFFICE

CERTIFICATE OF CORRECTION

PATENT NO. : 6,719,395 B2
DATED : April 13, 2004
INVENTOR(S) : Osamu Iwasaki et al.

It is certified that error appears in the above-identified patent and that said Letters Patent is hereby corrected as shown below:

Column 2,
Line 41, “element” should read -- elements --.

Column 15,
Line 52, “Th<Tth,” should read -- Th>Tth, --.

Column 17,
Line 23, “(T-T*l*)]” should read -- (T-T1)] --; and
Line 58, “exp[-2*m*t]+” should read -- exp[-2*m*t]}+ --.

Column 24,
Line 56, “said]” should be deleted.

Signed and Sealed this

Twenty-eighth Day of December, 2004

JON W. DUDAS
*Director of the United States Patent and Trademark Office*